US010155354B2

(12) United States Patent
Steele

(10) Patent No.: US 10,155,354 B2
(45) **Date of Patent: *Dec. 18, 2018**

(54) STATIONARY CLOSURE DEVICE AND PACKAGE

(71) Applicant: Mark Steele, New Prague, MN (US)

(72) Inventor: Mark Steele, New Prague, MN (US)

( * ) Notice: Subject to any disclaimer, the term of this patent is extended or adjusted under 35 U.S.C. 154(b) by 779 days.

This patent is subject to a terminal disclaimer.

(21) Appl. No.: 14/175,961

(22) Filed: Feb. 7, 2014

(65) Prior Publication Data

US 2014/0155240 A1 Jun. 5, 2014

Related U.S. Application Data

(63) Continuation of application No. 12/861,558, filed on Aug. 23, 2010, now abandoned, which is a continuation-in-part of application No. 12/116,726, filed on May 7, 2008, now Pat. No. 8,613,547, which is a continuation-in-part of application No. 11/737,866, filed on Apr. 20, 2007, now Pat. No. 7,883,268, which is a continuation of application No. 11/268,674, filed on Nov. 7, 2005, now Pat. No. 7,207,717.

(60) Provisional application No. 60/916,442, filed on May 7, 2007, provisional application No. 60/917,078, filed on May 10, 2007, provisional application No. 60/952,311, filed on Jul. 27, 2007, provisional application No. 60/987,588, filed on Nov. 13, 2007, (Continued)

(51) Int. Cl.

| | |
|---|---|
| ***B65D 33/16*** | (2006.01) |
| ***B31B 70/00*** | (2017.01) |
| ***B65D 33/01*** | (2006.01) |
| *B65D 75/00* | (2006.01) |
| *B31B 155/00* | (2017.01) |
| *B31B 160/20* | (2017.01) |
| *B31B 70/855* | (2017.01) |
| *B31B 160/10* | (2017.01) |

(52) U.S. Cl.

CPC ..... *B31B 70/00* (2017.08); *B65D 33/01* (2013.01); *B65D 33/16* (2013.01); *B31B 70/855* (2017.08); *B31B 2155/00* (2017.08); *B31B 2155/001* (2017.08); *B31B 2155/0014* (2017.08); *B31B 2160/10* (2017.08); *B31B 2160/20* (2017.08); *B65D 75/008* (2013.01)

(58) Field of Classification Search

CPC . B29C 66/71; B29C 66/53262; B65D 75/008; B65D 33/16

USPC ..... 383/63, 45, 59, 65, 93, 64, 38, 10, 95, 383/104, 3, 42, 43, 44; 24/585.11, 585.1, 24/584.1, 585.12, 399, 400

See application file for complete search history.

(56) References Cited

U.S. PATENT DOCUMENTS 6,132,089 A * 10/2000 Galomb ..... B65D 33/1658 383/120

6,641,307 B2 * 11/2003 Matsuda ..... B65D 75/5866 383/38

(Continued)

*Primary Examiner* — Christopher Demeree

(74) *Attorney, Agent, or Firm* — McCarter & English, LLP

(57) ABSTRACT

A flexible package is disclosed. The flexible package includes at least one shape memory closure provided at an access opening of the package. A method of forming and dispensing contents from a flexible package is also disclosed. Various shape memory closures can be bubble-shaped or dome-shaped and can be hollow fluid-filled, solid, and the like.

20 Claims, 31 Drawing Sheets

Related U.S. Application Data provisional application No. 60/625,391, filed on Nov. 5, 2004.

(56) References Cited

U.S. PATENT DOCUMENTS

| | | | | |
|---|---|---|---|---|
| 6,655,837 | B2 * | 12/2003 | Matsuda | B65D 75/5866 383/104 |
| 6,854,886 | B2 * | 2/2005 | Piechocki | B65D 33/2516 24/584.1 |

* cited by examiner

STATIONARY CLOSURE DEVICE AND PACKAGE

PRIORITY

This application is a continuation of U.S. patent application Ser. No. 12/861,558, filed Aug. 23, 2010, which is a continuation-in-part of U.S. patent application Ser. No. 12/116,726, filed May 7, 2008, now U.S. Pat. No. 8,613,547, issued Dec. 24, 2013, which is a continuation-in-part of U.S. patent application Ser. No. 11/737,866, filed Apr. 20, 2007, now U.S. Pat. No. 7,883,268, issued Feb. 8, 2011, which is a continuation of U.S. patent application Ser. No. 11/268,674, filed Nov. 7, 2005, now U.S. Pat. No. 7,207,717, issued Apr. 24, 2007, which claims priority to and the benefit of U.S. Provisional Application Ser. No. 60/625,391, filed Nov. 5, 2004. U.S. patent application Ser. No. 12/116,726 also claims priority to U.S. Provisional Application Ser. No. 60/916,442, filed May 7, 2007, to U.S. Provisional Application Ser. No. 60/917,078, filed May 10, 2007, to U.S. Provisional Application Ser. No. 60/952,311, filed Jul. 27, 2007, and to U.S. Provisional Application Ser. No. 60/987,588, filed Nov. 13, 2007. The disclosures of each of the above-referenced applications are hereby incorporated by reference herein in their entirety.

FIELD

The present invention relates generally to flexible packaging and, more particularly, to packages, and methods for manufacturing and using packages, having fluid actuated closures and secondary closures or seals.

BACKGROUND

Conventional flexible packages generally include external or integrated sliding means or other similar devices designed to allow a user to selectively gain access into the pouch or package. Traditionally, non-integrated, twist ties and other tying means have also been used to close an open-end portion of a flexible package. These devices often require the manufacturing of additional and often costly materials and/or devices into the packages.

Due to the problems associated with external closure devices for packages, the industry has developed integrated closeable devices. U.S. Pat. Nos. 4,913,561, 5,692,837, and 6,186,663 disclose such packaging. Current typical reclosable devices, most commonly known as zippers, tend to be pre-made at separate manufacturing sites and then shipped to the site where the actual package is manufactured. The reclosable device is then introduced into the packaging machinery and typically heat sealed into or onto the package. These reclosable devices usually are comprised of two pieces that have been mated together by male and female interlocking members. The mating process is usually performed by either pinching the two interlocking members together (press-to-close mechanism) or sliding a mechanism (zipper mechanism) along the top of the reclosable device, which causes the two interlocking members to be interlocked.

These press-to-close closure mechanisms are sometimes difficult to align when attempting to mate together, often causing a failure of a true closure. Furthermore, when a packager is filling the package through the press-to-close closure mechanism, and when the consumer is pouring the contents out of the package, small pieces of the product can get caught in tracks of the mating interlocking members, causing a breach across the interlocking components and hampering any positive seal. The compromise of the integrity of the seal between the mating locking components may also be caused by localized crushing (e.g., proximate side seal) of the interlocking members during manufacturing, shipping, handling, and use by the consumer. The localized crushing need only be enough to plastically deform either of the interlocking members to cause a leak.

Further, most zipper-type closure mechanisms merely serve to close off the top portion of the package by pulling or forcing together the top portions of the front and back panels of the package. This zipper-type closure mechanism has two significant drawbacks. First, it reduces the internal holding volume of the package since, in a closed position, side gussets of the package are forced to contact at an end proximate the access opening. Second, a space or gap can remain when the zipper-type closure mechanism is in its closed position. The gap permits air to flow in and out of the package. Although the zipper-type closures may be easier for some consumers to operate, and may have a more positive closure with respect to the press-to-close closure mechanism, they can be expensive and, like the press to close closure mechanisms, often do not create an ideal barrier after the package has been opened by the consumer for the first time.

Some designs of the zipper and press-to-close mechanisms are suitable for maintaining a water or liquid tight seal. However, the interlocking members of both the zipper and the press-to-close closure mechanisms may also allow for fluid leakage and they may undergo plastic deformation after repeated use that adversely affects the ability of the mechanism to seal fluids. Moreover, the zipper and press-to-close mechanisms may not be suitable for a gas tight seal. Accordingly, the contents of the package are susceptible to oxidation and other air-borne problems, such as the release of odors.

As a result, there is a need for a flexible package that substantially solves the above-referenced problems with conventional package designs, configurations, and manufacturing methods.

SUMMARY

One embodiment is directed to a flexible package for holding a fluid. The flexible package includes a flexible body defining an inner cavity and a throat portion. It also includes a fluid filled closure disposed in the throat portion that is configured to seal the inner cavity and defines an interface area therein. A metering chamber is provided that permits fluid communication from the inner cavity to the metering chamber via the interface area. The fluid communication is facilitated by an increase in pressure in the inner cavity.

Another embodiment is directed to a method of dispensing fluid from a flexible package. The method includes squeezing a body portion of a flexible package to force fluid contents in an inner cavity of the flexible package through a fluid filled closure provided to the body, thereby filling a metering chamber with at least some of the fluid contents.

Yet another embodiment is directed to a method of forming a flexible package. The method includes placing a tube between a bubble web and a first web to carry the air to inflate the bubble web. The bubble web is sealed to the first web, thereby trapping air in at least a portion of the bubble web.

The above summary is not intended to describe each illustrated embodiment, claimed embodiment or implementation of the invention. The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The invention may be more completely understood in consideration of the following detailed description of various embodiments of the invention in connection with the accompanying drawings, in which.

Figure 1:
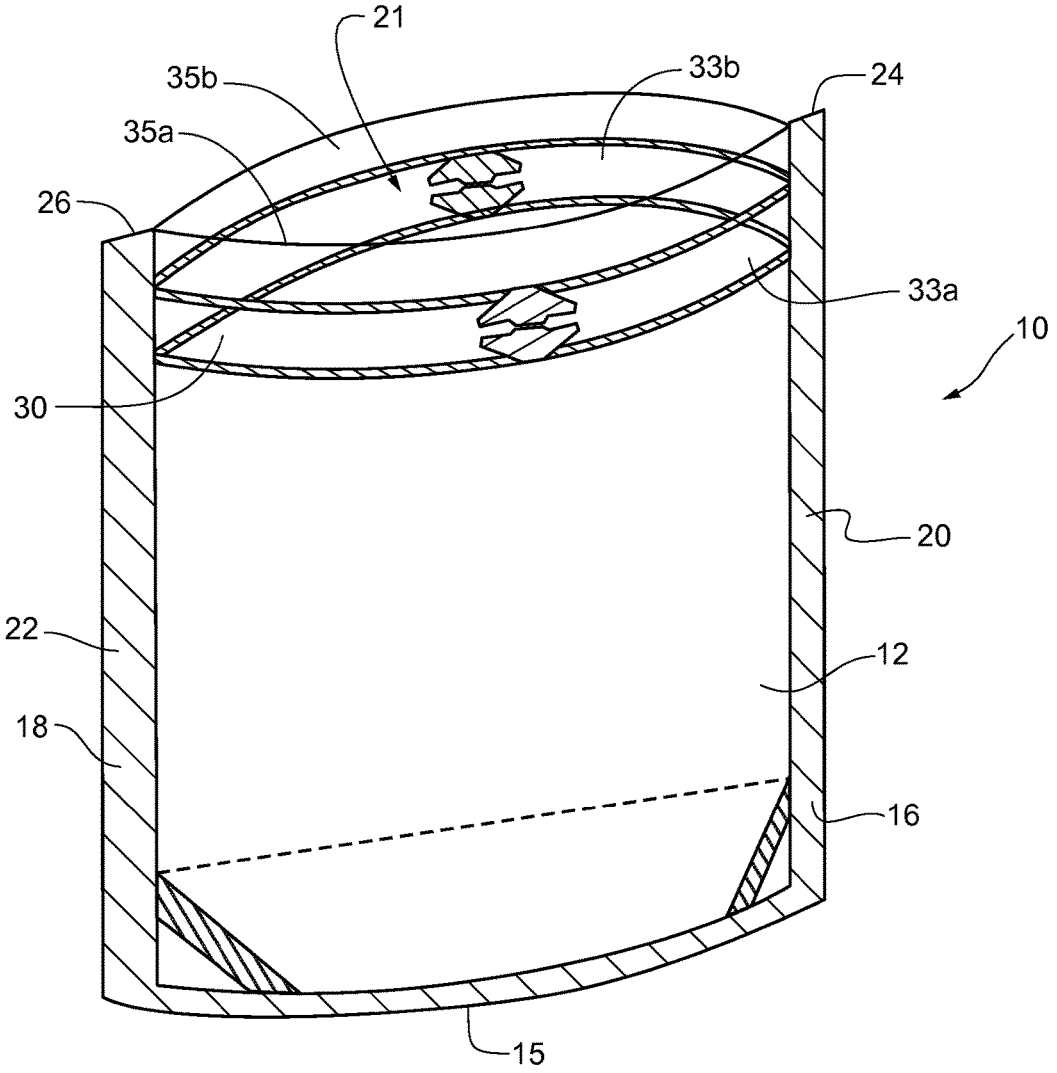
FIG. 1 is a perspective view of one embodiment of a flexible package having a fluid actuated closure mechanism, with the top of the package unsealed.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, hatching or shading in the figures is generally provided to demonstrate sealed or crushed portions and/or integrated devices for the package.

DETAILED DESCRIPTION OF THE INVENTION

Figure 3:
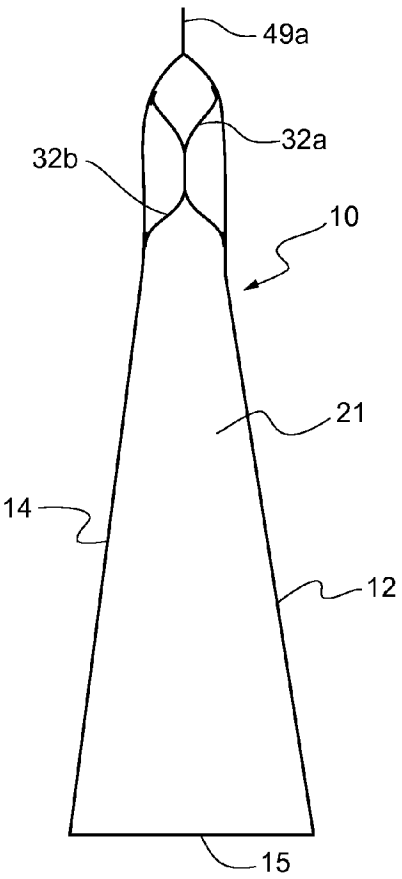
FIG. 3 is a cross-section view of the embodiment of FIG. 2 at line 3-3.
Figure 2:
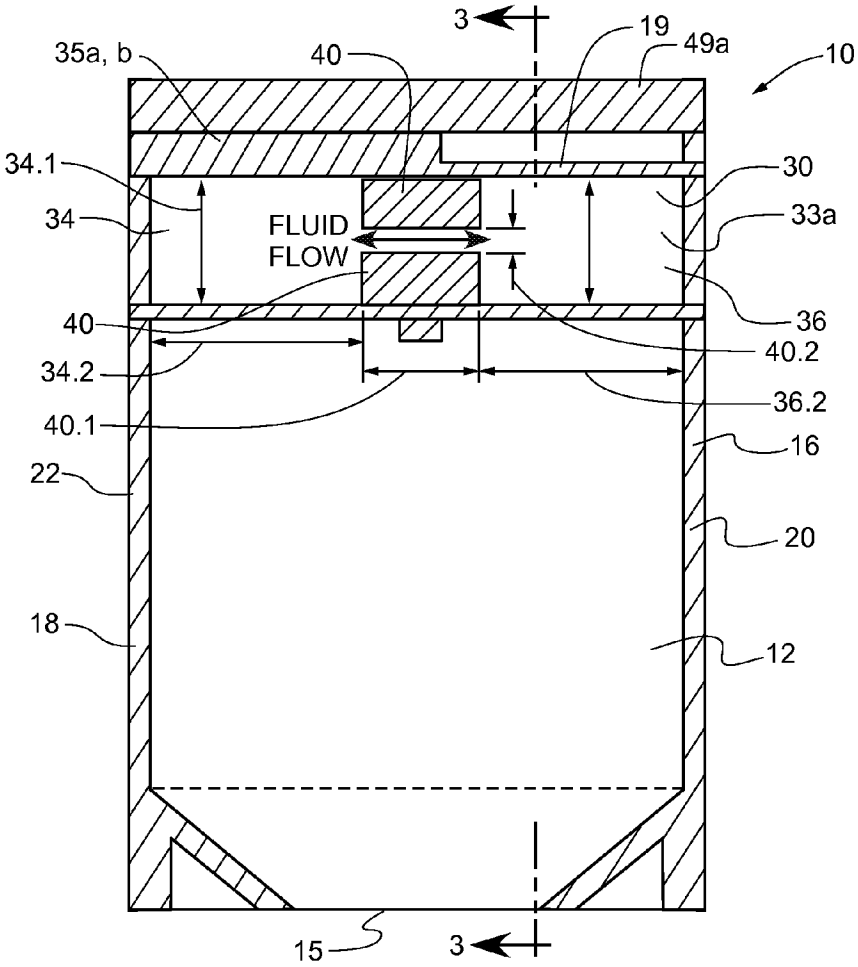
FIG. 2 is a front view of one embodiment of a flexible package having a fluid chamber with a reservoir portion and a closure portion.

Referring generally to FIGS. 1-16, a flexible package 10 in accordance with the present invention is shown. Referring generally to FIGS. 1-3, the package 10 generally includes a front panel portion 12, a back panel portion 14. Further, a bottom panel portion 15, gusseted or non-gusseted, can be included, especially in those embodiments defining a stand up package. The joining and/or shaping of the panels 12, 14, 15, generally define an inner cavity 21 having an adjustable internal volumetric capacity. The inner cavity 21 is capable of storing, transporting and/or dispensing product or other objects and material therein. Side panel portions (not shown), gusseted or non-gusseted, may also be included. The panel portions 12-15 are often referred to as webs, films or layers.

The package panel portions 12-15 are generally constructed of a flexible sheet material such as polyethylene, polyester, metal foil, polypropylene, or polyethylenes laminated with other materials such as nylon, polyester, and like films. To provide for higher barriers, embodiments can use combination layers of said materials and materials of the like. Generally, in such embodiments, a material having preferred sealing characteristics can be joined or bonded to a material having a different preferred characteristic (i.e., beneficial oxygen barrier properties). Preferably, the package of the present invention is to be formed into a stand-up pouch, but it could be a pouch that displays lying down, or in other package and pouch shapes and configurations known to one skilled in the art.

In one embodiment, the front panel portion 12 and the back panel portion 14 will be formed of one contiguous web material. In alternative embodiments, at least one of the panel portions 12-15 can be distinct web materials joined or sealed to other respective panel portions to form the package 10 of the present invention. For instance, the front panel portion 12 and the back panel portion 14 can be joined to each other from distinct non-contiguous web sheets of material, and one of said panel portions 12-14 can further extend to define the bottom panel portion 15. The bottom panel portion 15 in the various configurations forming a stand up pouch can include a gusset known to those skilled in the art to further promote operative expansion and contraction of the package 10 and its respective capacity in accordance with the receipt and removal of material within the package 10.

The front panel portion 12 generally includes a first front longitudinal edge 20 and a second front longitudinal edge 22. Both of said front panel longitudinal edges 20, 22 may be substantially parallel to each other and extend along the longitudinal length of the front panel portion 12. Likewise, the back panel portion 14 generally includes a first back longitudinal edge 24 and a second back longitudinal edge 26, also substantially parallel to each other and spanning the longitudinal length of the back panel portion 14.

In one embodiment, the first front longitudinal edge 20 can be sealably joined to the first back longitudinal edge 24 along the length of the edges 20, 24 to form first side seal 16. Similarly, the second front longitudinal edge 22 can be sealably joined to the second back longitudinal edge 26 along the length of edges 22, 26 to form second side seal 18. These side seals 16, 18 generally define the side boundaries of the package 10 and can be sealably joined using heat, adhesive, and other bonding techniques known to one of ordinary skill in the art.

Referring to FIGS. 1-4, the flexible package 10 includes a fluid actuated closure 30 attached to or integrated to the flexible package 10 to permit a user to selectively reclose the access opening 19. In one embodiment of the invention, the fluid actuated closure 30 includes at least one first web barrier or layer 32*a* joined to an inner surface of the front panel portion 12 of the package 10 and at least one second web barrier or layer 32*b* joined to an inner surface of the back panel portion 14 of the package 10, such that the first 32*a* and second 32*b* web barriers are generally opposed (e.g. FIG. 3). Alternatively, only one web bather or layer 32*a* joined to an interior of a panel portion (e.g., front panel portion 12, as depicted in FIG. 3A), such that the barrier 32*a* confronts the interior of the opposing panel portion (e.g., back panel portion 14) or some other structure of the package 10 to provide selective opening, closing of the package 10 through sealing of the access opening 19 as described herein. When the access opening 19 and fluid actuate closure 30 are positioned along a limited portion of the package (e.g., an opening into a moist toilette container or package), the closure permits a liquid and air seal to preserve the contents after the initial opening of the package.

The front 12 and back 14 panel portions and the first 32*a* and second 32*b* web bathers can define at least two fluid chambers or tubes 33*a* and 33*b* that extend generally along a long axis of the access opening 19, generally transverse to the side seals. In another embodiment, the fluid chambers 33*a* and 33*b* may be a laminate formed by trapping or positioning a bather film between two layers of a sealant film, preferably a Nylon or EVOH barrier film co-extruded between two layers of polyethylene. The fluid chambers 33*a* and 33*b* are sealed into the top section of the package 10 where typically air, or gas, liquid, or a similar item, is introduced between the first web barrier 32*a* and the front panel portion 12 of the package 10 and between the second web barrier 32*b* and the back panel portion 14 of the package 10, or if using tubes, it will be introduced into the tubes. This will create one or more generally opposed balloon type bubbles in a top portion or section of the package 10. Further, the barrier or layers 32*a*, 32*b* and corresponding chambers 33*a*, 33*b* can be formed from a portion of the package 10, such as by folding a part of the package 10 or the respective panels 12, 14 over to create a fluid containable chamber or layer.

Each of the fluid chambers 33*a* and 33*b* may include one or more reservoir or storage portions 34 having a nominal width 34.1 and a nominal height 34.2, as well as one or more closure portions 36 having a nominal width 36.1 and a nominal height 36.2 and in fluid communication with the reservoir portion 34 through a fluid regulator 40. As shown in the package 10 of FIGS. 1, 2 and 4, portions 35*a*, 35*b* of the package above the respective reservoir portions 34 of the chambers 33*a*, 33*b* are joinable from edge 22 to a point generally short of edge 20, preferably proximate the fluid regulator 40, using known joining or sealing techniques. As such, access into the internal cavity 21 of the package 10 is generally limited to the access opening 19 proximate the closure portion 36 as the portion above the reservoir portion 34 is closed off. Other embodiments are envisioned where the access opening 19 and portions 34, 36 are positioned elsewhere along the package 10 (e.g., along one or more of the side, or front and back panels).

The fluid regulator 40 may be formed and/or disposed between the reservoir portion 34 and the closure portion 36 of each of the chambers 33*a* and 33*b* to regulate the transfer and/or flow of fluid therebetween. The fluid regulator 40 may simply be a narrow channel 41 of two opposing but proximate film portions or materials, as depicted in the figures. The narrow channel 41 may be characterized by a length 40.1 and a throat major dimension 40.2. The two opposing film portions may also define a minor throat dimension (not depicted), or be in contact with each other to provide a restrictive flow passage. The fluid regulator 40 may also comprise various one-way or two-way valve devices, or a myriad of other known regulators or methods and techniques of regulating fluid flow through such channels known to one of ordinary skill in the art (not depicted). Generally, movement of the fluid from the reservoir portion 34 into the closure portion 36 of each of the fluid chambers 33*a* and 33*b* seals the access opening 19 of the package 10. The opening 19 is sealed due to the conforming abutment or seating of the inflated portions 36 against one another. Likewise, movement of the fluid from the closure portion 36 of each of the fluid chambers 33*a* and 33*b* into the reservoir portion 34 unseals the access opening 19 of the package 10.

In one embodiment of the invention, the reservoir portion 34 and the closure portion 36 of each of the fluid chambers 33*a* and 33*b* may each be at least partially filled with fluid. In this particular state, the access opening 19 may be partially unsealed or opened, which would allow a user or packager to deposit a product or good into the interior of the package 10. To seal the access opening 19, a user may exert a force upon the reservoir portion 34, such as by a squeezing motion, to move generally all of the fluid from the reservoir portion 34 into the closure portion 36 of each of the fluid chambers 33*a* and 33*b*. Further, a plurality of generally distinct chambers 33*a*, 33*b* or bubbles/tubes can be implemented to achieve such partial closure or opening such that the access opening is opened or closed in steps according to the number or size of the chambers 33*a*, 33*b*. Such an embodiment can provide a plurality of bubbles or chambers that can provide progressive or stepped inflation or deflation and, thus, progressive or stepped opening or closing of the package at the access opening 19. As illustrated in FIG. 3, when generally all of the fluid is disposed in the closure portions 36 they selectively block and positively seal the access opening 19. To facilitate closure, the closure portion 36 of each of the fluid chambers 33*a* and 33*b* does not necessarily need to be fully inflated to high volumes of pressure, as only enough pressure to seat or abut the chambers 33*a*, 33*b* against each other is necessary.

In another embodiment, the user may lightly pinch the end of the reservoir portion 34 that is near the side seal 18 between two fingers and slide the across the reservoir portion 34 towards the regulator 40, akin to a zipper-like action that one uses in sealing a zipper lock package. The action typically displaces the fluid from the reservoir portion 34 into the closure portion 36. Opening the closure portion 36 may be accomplished in the same manner by sliding a light pinching grip across the closure portion 36 to return the fluid to the reservoir portion 34.

In another embodiment, the fluid regulator 40 may be tailored to enable slow movement of fluid between the reservoir portion 34 and the closure portion 36 without application of force. That is, the fluid regulator 40 may be configured to effectively provide a slow leak therethrough even when no external force is applied to one of the reservoir portion 34 and the closure portion 36. An exemplary and non-limiting range of dimensions for the fluid actuated closure 30 that implements such a "slow pass" fluid regulator 40 may comprise the narrow channel 41 with a length 40.1 ranging from about 6-mm to about 50-mm (approximately ¼- to 2 inches) and the throat major dimension 40.2 ranging from about 2-mm to about 6-mm (approximately 1/16- to ¼-inch). Exemplary and non-limiting dimensions for the lengths 34.2 and 36.2 for the reservoir and closure portions 34, 36, respectively, may range from about 25- to 150-mm (approximately 1- to 6-inches), with heights 34.1 and 36.1 that may range from about 6- to 40-mm (approximately ¼- to 1½-inches). To facilitate opening and closing the package 10 with a zipper-like action, narrower heights for the 34.1 and 36.1 dimensions (on the order of 6- to 10-mm) may be preferred.

In operation, consider the "slow pass" fluid regulator 40 with, for example, a volume of air that has been manipulated to reside primarily in the reservoir portion 34. The presence of more air in the reservoir portion 34 may cause the air therein to expand against the wall of the reservoir portion 34 and thus be at a higher pressure than the air remaining within the closure portion 36. The bulk of the higher pressure air in the reservoir portion 34 may remain therein for a period long enough to enable a user to remove product from the flexible container 10 through the access opening 19 of the closure portion 36. Thereafter, the pressure difference between the reservoir portion 34 and the closure portion 36 may slowly migrate back into the closure portion 36 as the two chambers 34 and 36 approach equalization. For an air volume that is properly sized, the closure portion 36 will be closed as the pressures approach equalization. In some embodiments, the pressure between the closure portion 36 and the reservoir portion 34 may not reach equalization but still function to effectively contain the product.

By this mechanism, the "slow pass" fluid regulator 40 essentially closes automatically over a period of time, thereby retaining product freshness should the user forget to reseal the bag. It is understood that the gradual migration between the reservoir portion 34 and the closure potion 36 may be overridden for a more rapid sealing by application of an external force, as described above.

Figure 4:
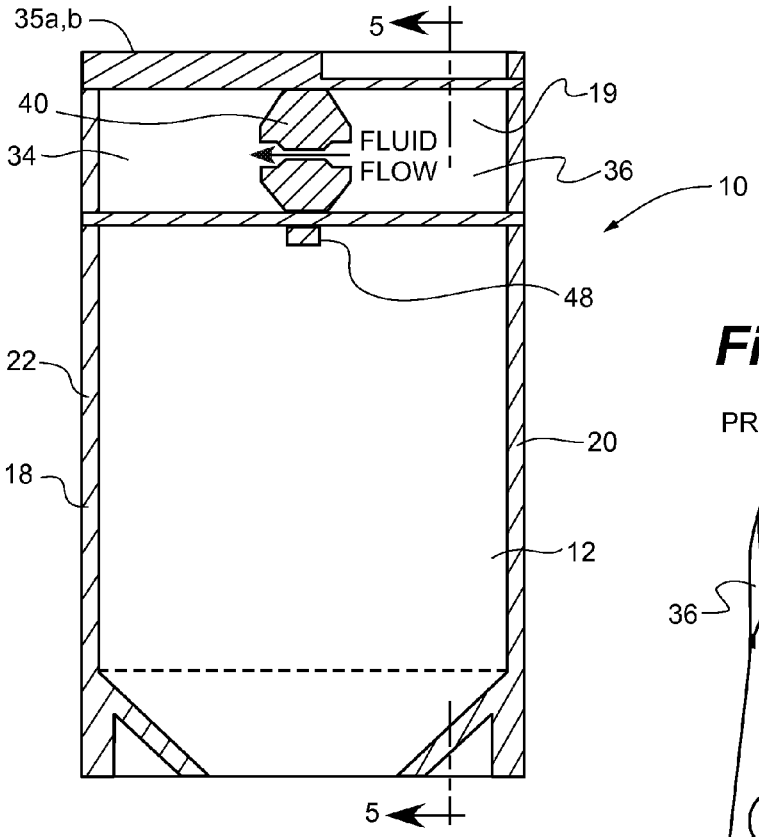
FIG. 4 is a front view of one embodiment of a flexible package having the fluid actuated closure without a top seal.
Figure 5:
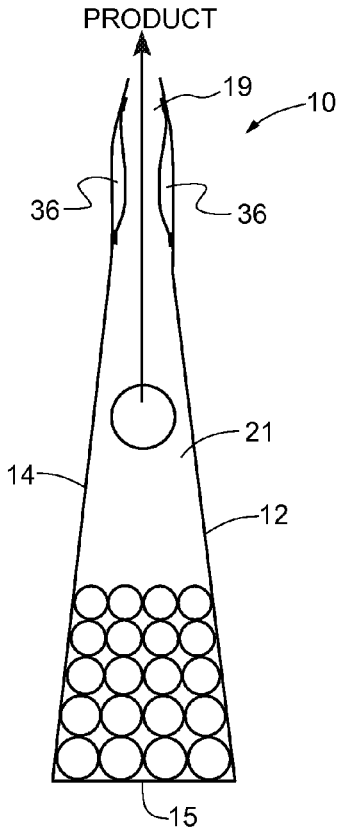
FIG. 5 is cross-section view of the embodiment of FIG. 4 with the fluid actuated closure in an opened or deflated state.
Figure 6:
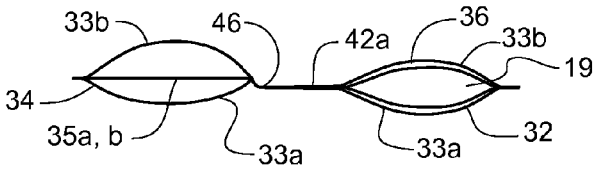
FIG. 6 is a top view of the embodiment of FIG. 3 having a fluid actuated closure mechanism in an opened or deflated state.

To access the interior of the package 10 a user needs to move the fluid from the closure portion 36 of each of the fluid chambers 33*a* and 33*b* into the reservoir portion 34. To move the fluid from the closure portion 36 to the reservoir portion 34 a user exerts a force upon the closure portion 36 of each of the fluid chambers 33*a* and 33*b*, such as by a squeezing motion. As illustrated in FIGS. 4-6, the closure portion 36 of each of the fluid chambers 33*a* and 33*b* begin to deflate as the fluid flows through the regulator 40 and into the reservoir portion 34. When the closure portion 36 of each of the fluid chambers 33*a* and 33*b* are deflated the access opening 19 is unsealed and the contents of the package 10 are accessible. The contents of the package may include solid or fluid product.

Figure 7:
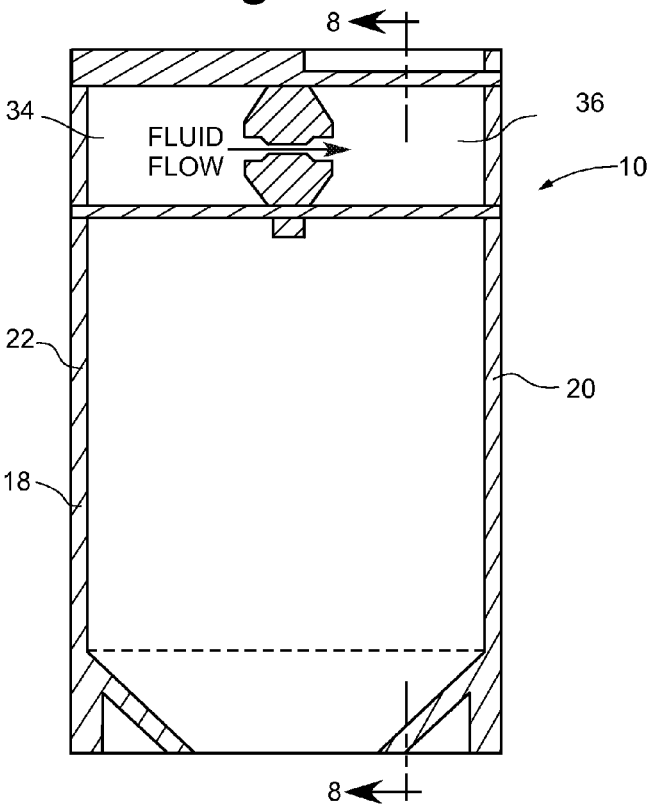
FIG. 7 is a front view of one embodiment of a flexible package with the fluid actuated closure in a closed position.
Figure 8:
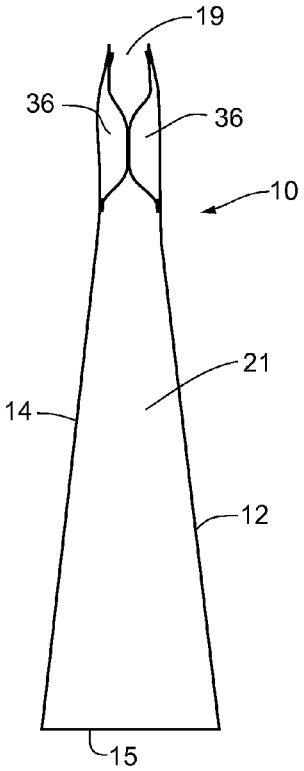
FIG. 8 is a cross-section view of the embodiment of FIG. 7 illustrating the fluid actuated closure in a closed or inflated state.
Figure 9:
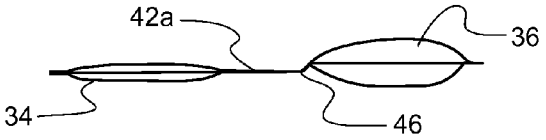
FIG. 9 is a top view of one embodiment of a flexible package having a fluid actuated closure in a closed position.

As illustrated in FIGS. 7-9, the package 10 may be resealed by squeezing the reservoir portion 34 at the top of the package 10, which causes the fluid to flow through the fluid regulator 40 and into the closure portion 36 of each of the fluid chambers 33*a* and 33*b*. As illustrated in FIGS. 8 and 9, as the closure portion 36 of each of the fluid chambers 33*a* and 33*b* fill or inflate the first 32*a* and second 32*b* barrier films between the front 12 and back 14 panels begin to compress and conform to each other, leaving no gaps, or substantially no gaps, for oxygen or liquid to pass or escape between them. This barrier feature is enhanced by the abutting nature of the chambers 33*a*, 33*b* and/or the material construction of the chambers (e.g., laminate or other material having oxygen barrier properties). The content of the package 10 can be kept fresher, for longer periods of time; even after the package 10 has been initially opened by the user. Materials and films having such barrier protective properties are known in the art and are envisioned for implementation with the present invention.

In one embodiment of the invention, at least one of the first 32*a* and second 32*b* barrier films, or the material defining the fluid regulator 40, can be made from a material having a high surface energy or static charge, such as saran polyvinylidene chloride or other like films and materials that have a tendency to adhere and/or cling to themselves or other objects. As such, the opposing chambers 33*a*, 33*b* are generally drawn in together when proximately positioned. In this embodiment, the combination of the inflation of the closure portion 36 of the fluid chambers 33*a* and 33*b* and the increased adhereability and/or clingability of the first 32*a* and second 32*b* barrier films ensures positive sealing of the package 10 when an object is disposed generally between the inflated closure portion 36 of the fluid chambers 33*a* and 33*b*. In another embodiment, the chambers can simply be strips 33*c*, 33*d* of such high energy material (not necessarily forming a chamber or tube) such that each strip 33*c*, 33*d* tend to cling or attract towards one another to provide a cling seal to provide for selective access into the package 10 and its contents. As such, the strips 33*c*, 33*d* draw toward one another to provide the seal, but can be easily removed or separated to provide access to the inner cavity 21. These strips 33*c*, 33*d* can run across the entire length of the top of the package 10, or just along a portion of the package 10 proximate the access opening 19. Other embodiments can utilize adhesives or other means of drawing or adhering the films or chambers together.

Figure 10:
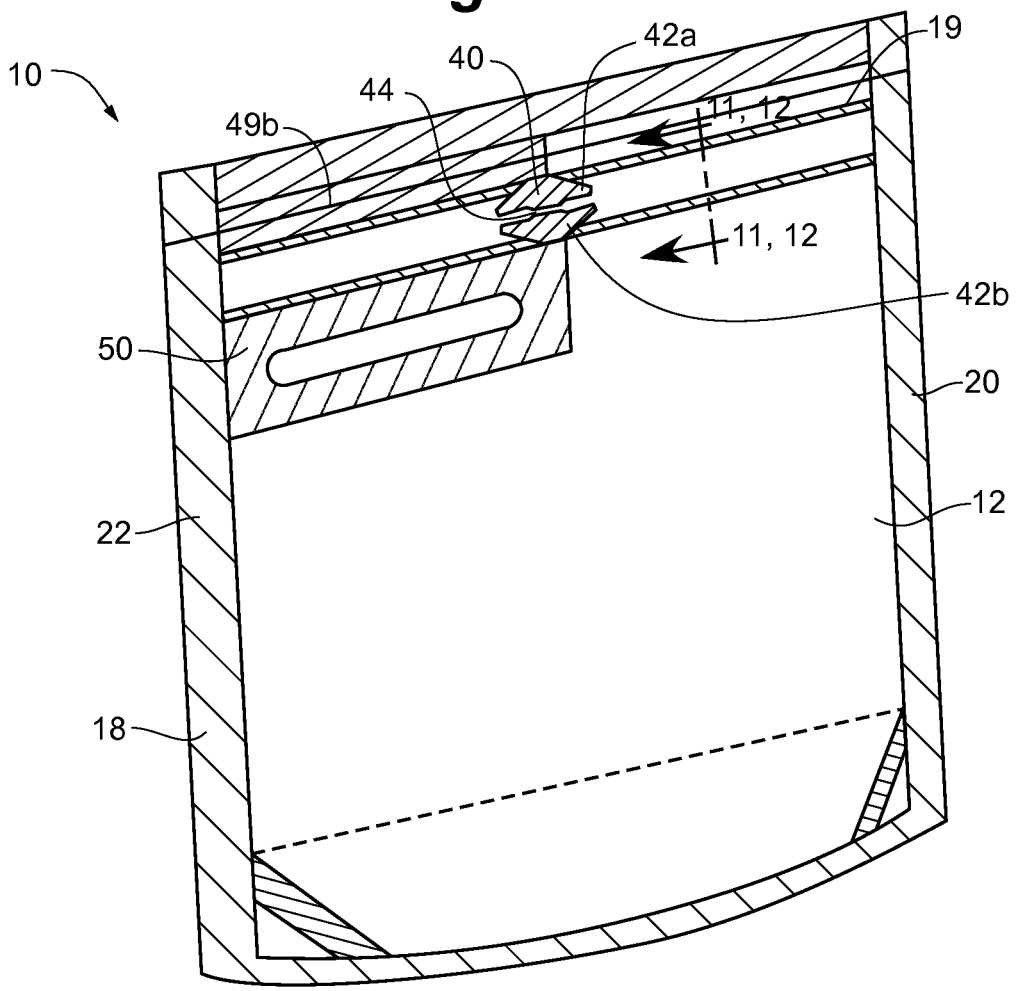
FIG. 10 is a front view of one embodiment of a flexible package having an integrated handle for carrying the package and a fluid regulator.
Figure 11:
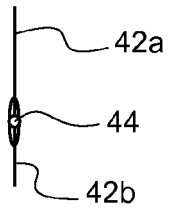
FIG. 11 is a cross-section view of FIG. 10 illustrating an embodiment of the fluid regulator in a closed position.
Figure 12:
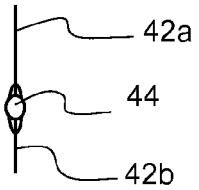
FIG. 12 is a cross-section view of FIG. 10 illustrating an embodiment of the fluid regulator in an open position.
Figure 13:
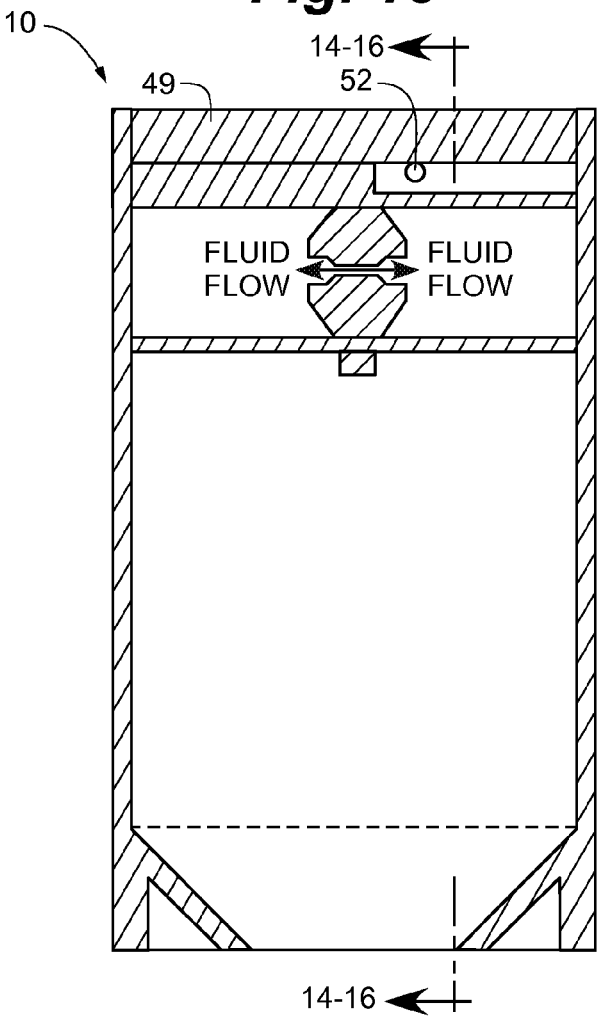
FIG. 13 is a front view of one embodiment of a flexible package having a fluid actuated closure and pressure outlet or vent.
Figure 14:
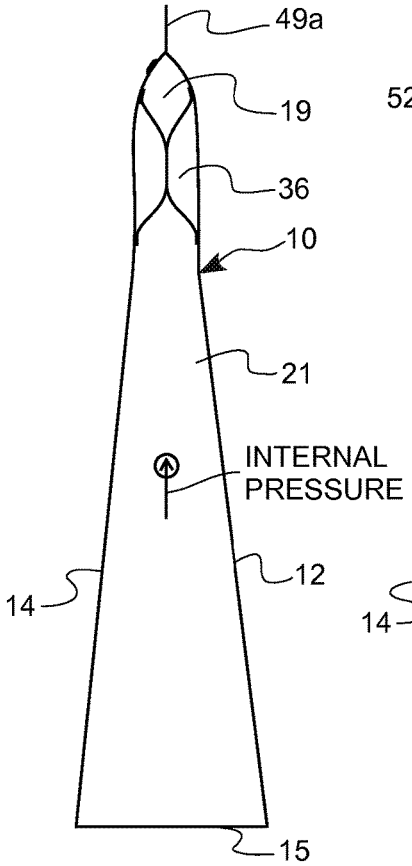
FIG. 14 is a cross-section view of FIG. 13 illustrating a generally higher internal pressure relative to an external pressure.

Referring to FIGS. 10-12, the fluid regulator 40 of each of the fluid chambers 33*a* and 33*b* may be disposed approximately halfway between each side of the package 10, although any percentage or distance across the package 10 is envisioned as long as there are sufficient air/bubble areas for the closure portion 36 and the reservoir portion 34. In one embodiment of the invention, as illustrated in FIGS. 11 and 12, the fluid regulator 40 may be formed by creating a partial sealed area or areas 42*a* and/or 42*b* generally across or along each of the fluid chambers 33*a* and 33*b*. As illustrated in FIGS. 11 and 12, a fluid restriction channel 44 may be formed between the partial sealed areas 42*a* and 42*b*. The fluid restriction channel 44 may have a generally constricted state, as illustrated in FIG. 11, such that fluid is not permitted to flow through without the application of a force (manual, mechanical, etc.) on the inflated reservoir portions 34 or closure portions 36. Upon the application of a force, or other means of moving the fluid, the fluid restriction channel 44 may expand or open to permit the fluid to flow, as shown in FIG. 12. The partially sealed area or areas 42*a* and/or 42*b* may be of any shape and size which selectively restricts the flow of fluid between the reservoir portion 34 and the closure portions 36 of the fluid chambers 33*a* and 33*b*. Other types of valves and fluid regulating mechanisms known to one skilled in the art may also be utilized to regulate the flow of fluid between the chambers or package portions.

In an embodiment of the invention, as illustrated in FIGS. 6 and 9, fluid movement between the reservoir portion 34 and the closure portion 36 may be restricted by creating a kink or bend 46 in the fluid chambers 33*a* and 33*b*. In an example embodiment, the kink 46 is formed when the fluid in one fluid chamber 33*a* or 33*b* is greater than the other. The fluid in the opposing fluid chamber 33*a* or 33*b* causes the fluid chamber 33*a* or 33*b* with more fluid to push further against the fluid chamber with less fluid, causing the kink 46 and restricting fluid flow across the portions 34, 36. In another embodiment, the fluid restriction channel 44 and kink 46 may be utilized together to ensure restriction of a flow of fluid between the reservoir portion 34 and the closure portion 36 of the fluid chambers 33*a* and 33*b*.

An intermediate seal 48 may be made just above and potentially just under the kink 46 and/or fluid restriction channel 44 in the fluid chambers 33*a* and 33*b*, as shown in FIG. 4. The intermediate seal 48 will seal the front 12 and back 14 panels of the package 10 together and ensure that they cannot separate except where the fluid closure portions 36 of the fluid chambers 33*a* and 33*b* permit upon fluid movement. Furthermore, the intermediate seal 48 may be a dividing point between a side of the package 10 that will be accessible to the product, and a non-accessible side. The fluid restriction channel 44 and the fluid closure portion 36 of each of the fluid chambers 33*a* and 33*b* can be different sizes and shapes to fit the particular needs and functions of the package size and shape being used for a particular product.

Referring to FIGS. 2-3, and 13-16, a top seal 49*a* may be formed in the front 12 and back 14 panel portions (generally after packaging of the product/contents) to seal the access opening 19 of the package 10. A perforation, laser score, or tear line 49*b* may be formed or identified along a length of the top seal 49*a* to permit a user to easily remove or tear open the top seal and access the interior of the package 10 through the access opening 19. Other forms of sealing, such as peal and seal closures, slits, perforations, and the like can be incorporated with the package 10 and its inventive fluid actuated closure.

In one embodiment of the invention, as illustrated in FIG. 10, a carrying device or handle 50 may be joined to or formed on the package 10. The handle 50 may be disposed or sealed generally adjacent to at least one of the fluid chambers 33*a* and 33*b* and may have a planar surface generally parallel to the front 12 and/or back 14 panels. During use, the handle 50 may be folded generally upward for carrying the package. The handle 50 may be any size and shape. Additionally, the handle 50 may be made of multiples layers or a barrier material similar to other portions of the package 10 to add additional strength and reinforcement. This design also allows the handle to remain on the package after the consumer removes the top seal 49*a* to access the product.

Figure 15:
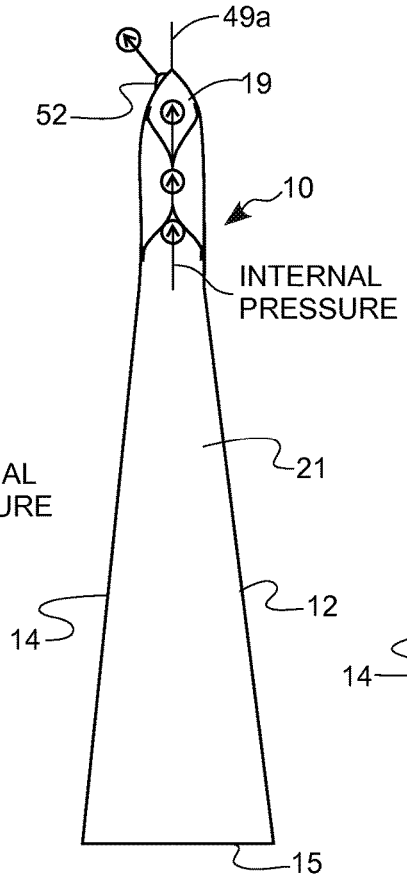
FIG. 15 is a cross-section view of FIG. 13 illustrating an escaping internal pressure through the fluid actuated closure and the pressure outlet or vent.
Figure 16:
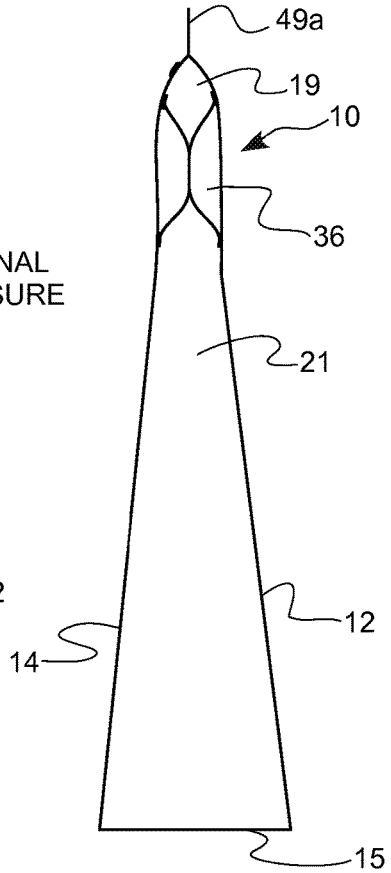
FIG. 16 is a cross-section view of FIG. 13 illustrating a resealing or reseating of the fluid actuated closure upon equalization of the internal and external pressure.
Figure 17:
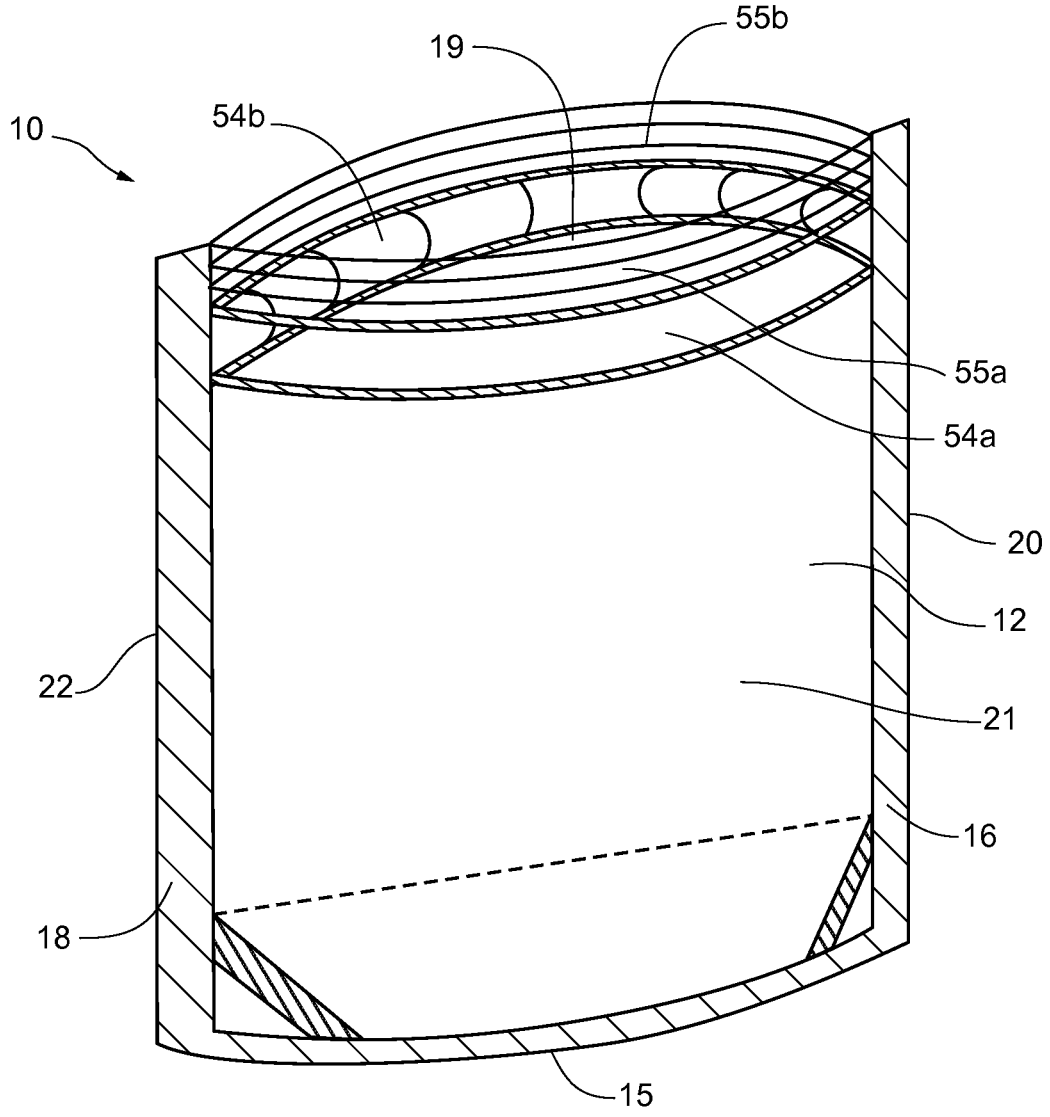
FIG. 17 is a perspective view of a package with fluid-filled chambers for sealing and a closure mechanism above the fluid-filled chambers in an embodiment of the invention.
Figure 18:
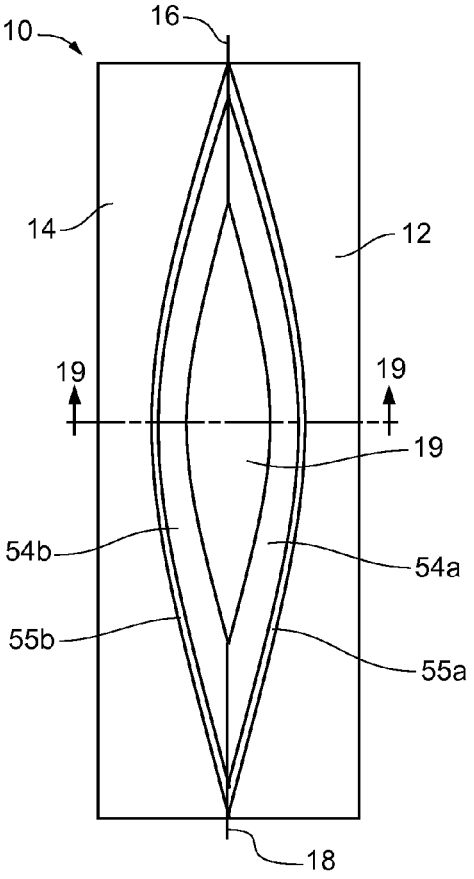
FIG. 18 is a top view of the package of FIG. 17 in an open position.
Figure 19:
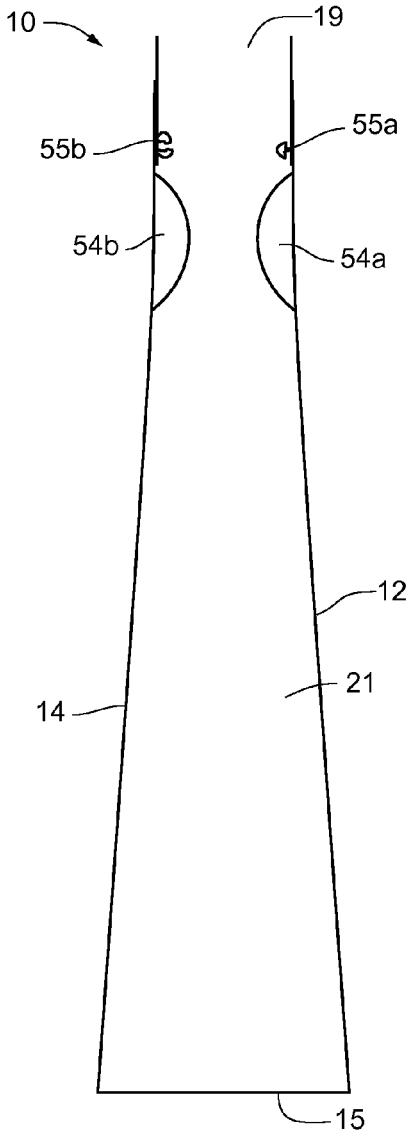
FIG. 19 is a cross-section view of the package of FIG. 18.
Figure 20:
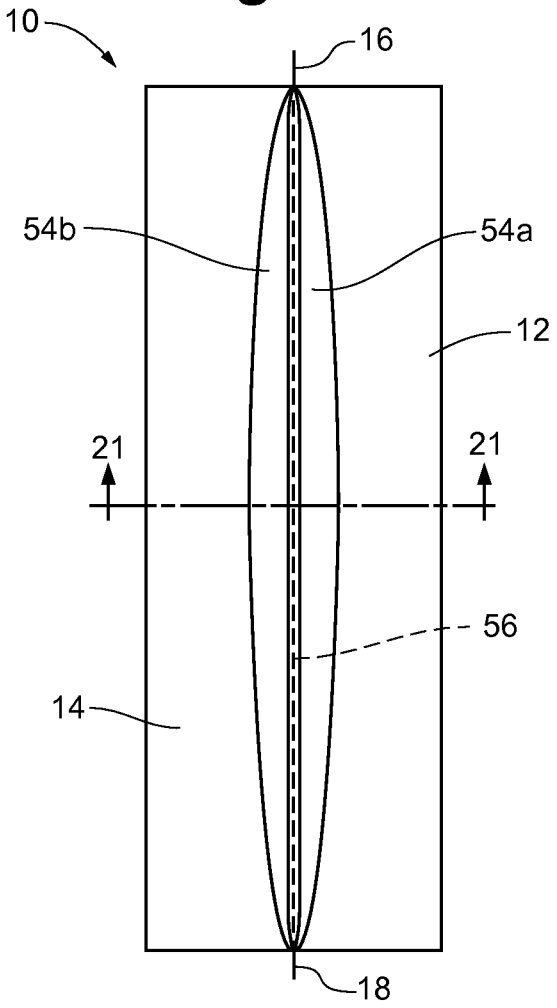
FIG. 20 is a top view of the package of FIG. 17 in a closed position.
Figure 21:
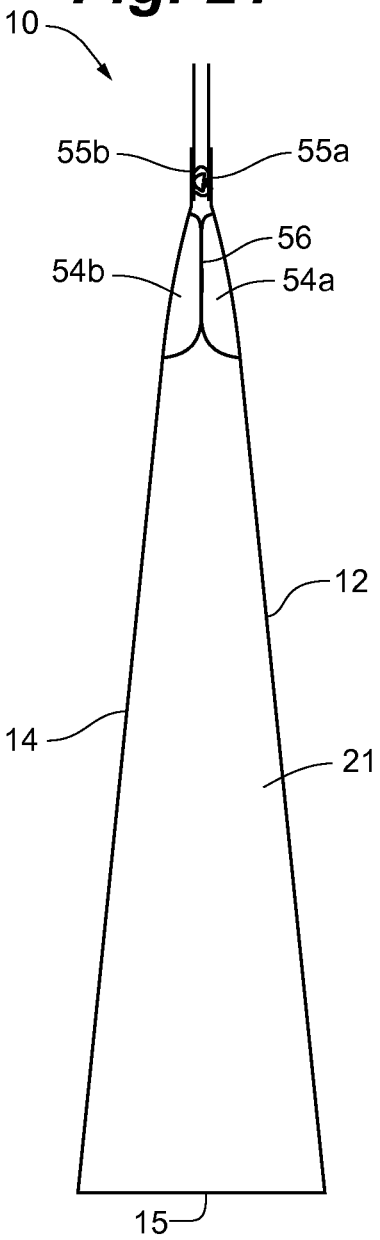
FIG. 21 is a cross-section view the package of FIG. 20.

In another embodiment of the invention, as illustrated in FIGS. 13-16, a portion of the front 12 or back 14 panels may include an outlet or aperture 52 to permit a gas in the package 10 to escape. When the closure portion 36 of the fluid chambers 33*a* and 33*b* are inflated, they can act as a release valve for internal products which produce a build up of gas or vapors (e.g. packaged coffee), keeping the package 10 from rupturing while preventing oxygen from outside the package 10 from getting in. As illustrated in FIG. 15, as the gas or vapor builds in the package 10, depending on the material makeup of the chambers 33*a*, 33*b* or the closure portion 36, it will be able to force its way between the two opposing closure portions 36 and escape through the outlet 52. As illustrated in FIG. 16, once the pressure created by the gas or vapor has been released, the closure portions 36 of each of the fluid chambers 33*a* and 33*b* can re-seat against one another, keeping any unwanted oxygen or other fluids from entering the package 10 through the access opening 19.

In other embodiments of the invention, the fluid chambers 33*a* and 33*b* can include a series of smaller fluid chambers or bubbles, long skinny rows of bubbles, or shaped bubbles that compress and or interlock/nest against each other. Depending on the access opening 19 size, and the degree or progressive nature of the closure, different bubble shapes and configurations can be employed.

Although the descriptions noted above are typically for pre-made package formats, it is also envisioned that someone skilled in the art could use this same method on form, fill, and seal machinery, or other packaging machines known to one of ordinary skill in the art. This closure method can be used on virtually any style package; including side gusseted packages, or other packages with transversely applied access devices, tie slits, discrete compartments, and the like. Examples of such packages are taught in U.S. patent application Ser. Nos. 10/396,295, 10/456,971 and 10/954,153, which are co-pending applications of the Applicant and are hereby incorporated by reference in their entirety herein. The tubes/chambers taught herein are generally envisioned for implementation during the manufacturing or forming of the package and/or during the packaging of the product. However, it is also envisioned that they could be preformed and introduced into the package during the manufacturing of the package and/or during the filling of the product into the package. The fluid chambers 33*a* and 33*b* or tubes can be pre-formed and/or pre-filled with air and could be pre-applied to the main package web or material either along or transversely to a machining or web direction of the package. In addition, the reservoir portions 34 and closure portions 36 can be provided along the side of the package, the bottom, the top, or a combination thereof. For instance, the reservoir portion 34 could be position along the side of the package proximate the longitudinal edges 20, 24, while the access opening 19 remains proximate the top of the package. Other variations and selective positioning for the portions 34, 36 are envisioned as well.

In one embodiment, the package 10 can include a pinching or closing-off device (not shown) positioned internally or externally to the package 10 to close off the fluid regulator 40 or its channel 44. Such a device can prevent fluid transfer between the reservoir 34 and closure 36 portions and can be actuated, engaged or otherwise utilized when it is necessary to prevent such fluid transfer during shipment, storage, use, etc. If, for instance, pressure is applied to the package 10 or its portions 34, 36 during shipment or storage, the fluid transfer will be restricted, thus preventing inadvertent opening of the package at the access opening 19. One exemplary embodiment includes an external clip device that will pinch the regulator channel 44 to close off fluid communication between the portions 34, 36 of the chambers 33*a*, 33*b*.

Additionally, various handles, valve devices, graphics or indicia, closeable and re-closeable devices, gusseted panels or portions, and like features or devices known to one skilled in the art are also envisioned for use with this invention and can be implemented without deviating from the spirit and scope of the present invention. All references to front, back, bottom, and the like are merely for demonstrative purposes and are not intended to limit the variations and positional references and orientations of the panels or the fluid actuated closure of the present invention.

Referring to FIGS. 17-21, the package 10 is depicted in an embodiment of the invention that includes a pair of fluid-filled chambers 54*a*, 54*b* proximate the opening 19. The fluid-filled chambers 54*a*, 54*b* and the opening 19 may extend essentially the width of the package 10 or opening 19. In one embodiment, the fluid-filled chambers 54*a*, 54*b* are located on opposite front and back panels 12 and 14, respectively, at substantially the same elevation. Interlocking members 55*a* and 55*b* are disposed on the front and back panels 12 and 14, respectively, just above the fluid filled chambers 54*a* and 54*b*. The interlocking members 55*a* and 55*b* may be a zipper closure, such as disclosed in U.S. Pat. No. 6,376,035 to Dobreski et al., the disclosure of which is hereby incorporated by reference except for terms expressly defined therein. Other fastening means that could be utilized include a press-to-close mechanism, such as disclosed in U.S. Pat. No. 4,703,518 to Ausnit, the disclosure of which is hereby incorporated by reference except for terms expressly defined therein.

The fluid-filled chambers 54*a* and 54*b* may be constructed of a suitable thin-walled elastic film known for retention or low permeability of gas, such as a polyethylene, a polyethylene/ethylene vinyl alcohol copolymer or other suitable polymers.

In operation, the package is closed by joining interlocking members 55*a* and 55*b*, which also causes chambers 54*a* and 54*b* to contact each other and form an interface area 56 that extends the width of the package 10 or opening 19. The holding force of the interlocking members 55*a* and 55*b* causes a pressure at the interface area 56 to positively seal the inner cavity 21. By this arrangement, the package 10 is sealed not only by the closure of the interlocking members 55*a* and 55*b*, but additionally by the contact between the fluid-filled chambers 54*a* and 54*b* which may enhance the integrity of the closure.

Figure 22:
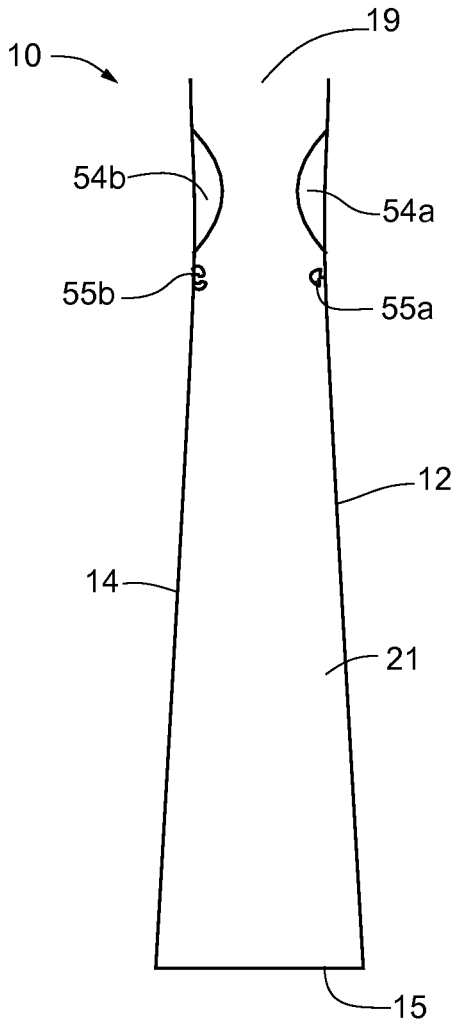
FIG. 22 is a cross-section view of a package in an open position with fluid-filled chambers for sealing and a closure mechanism below the fluid-filled chambers in an embodiment of the invention.
Figure 23:
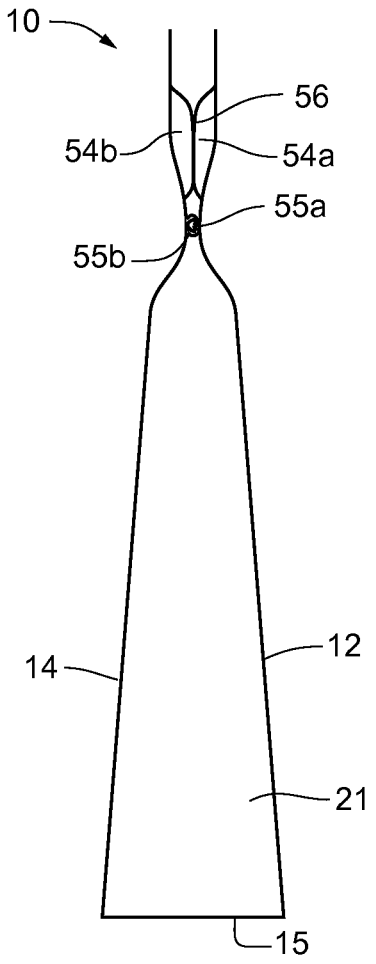
FIG. 23 is a cross-section view of the package of FIG. 22 in the closed position.

Referring to FIGS. 22 and 23, the package 10 is depicted in another embodiment of the invention. This embodiment can have all of the same components and operational aspects as the embodiment of FIGS. 17-20, but differs in the orientation of the interlocking members 55*a* and 55*b* relative to the fluid-filled chambers 54*a* and 54*b*. Here, the interlocking members 55*a* and 55*b* are located on the interior side of the interface area 56. Accordingly, the interlocking members 55*a* and 55*b* may form the primary seal, with the interface area 56 constituting a backup or secondary seal.

Figure 24:
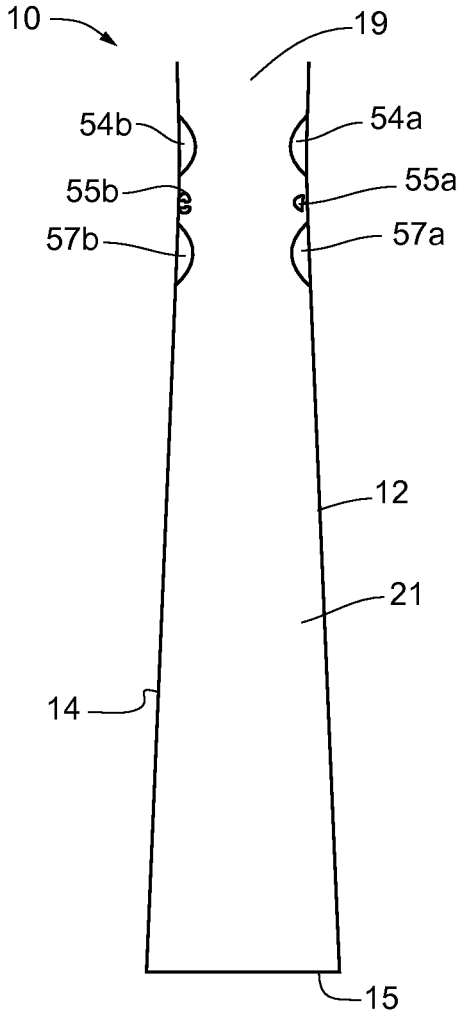
FIG. 24 is a cross-section view of a package in an open position with parallel pairs of fluid-filled chambers and a closure mechanism disposed between the parallel pairs of fluid-filled chambers for sealing in an embodiment of the invention.
Figure 25:
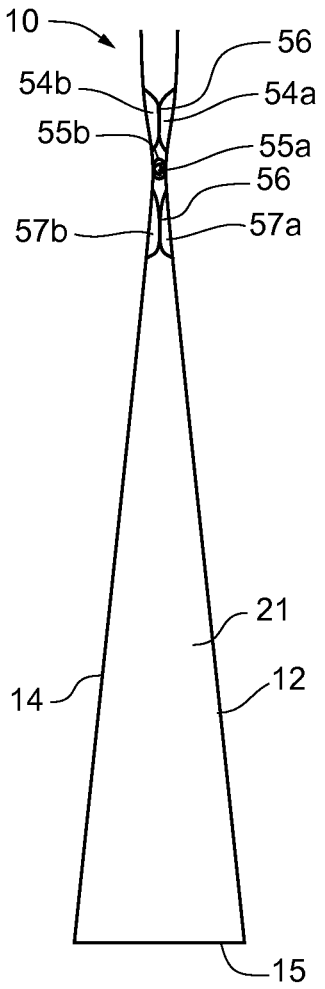
FIG. 25 is a cross-section view of the package of FIG. 24 in the closed position.
Figure 26:
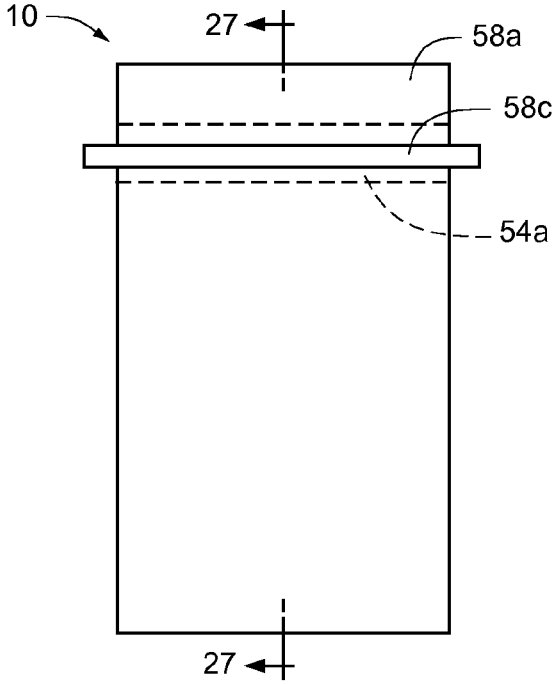
FIG. 26 is a front elevation view of a package having a tin-tie closure in an open position with fluid-filled chambers for sealing in an embodiment of the invention.
Figure 27:
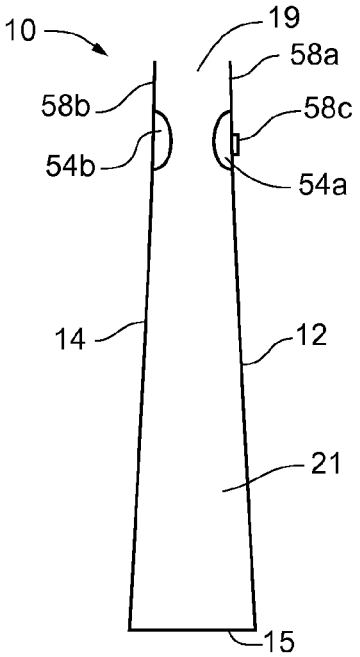
FIG. 27 is a cross-section view of the package of FIG. 26.
Figure 28:
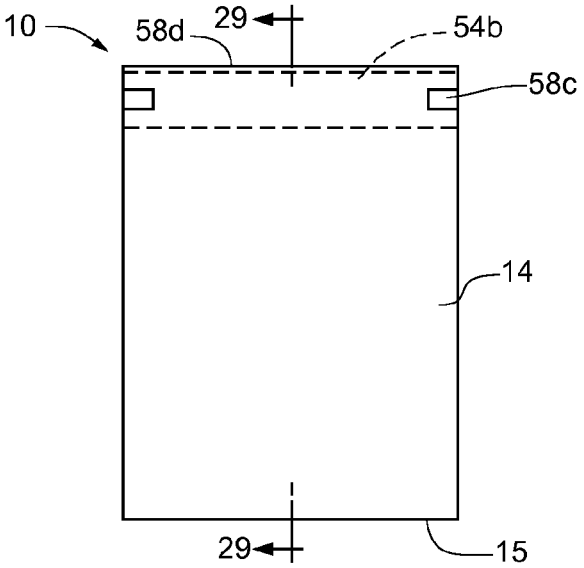
FIG. 28 is a front elevation view of the package of FIG. 26 in a closed position.
Figure 29:
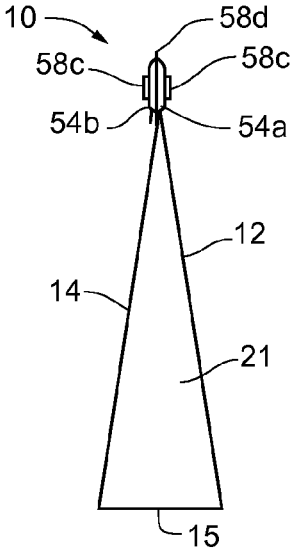
FIG. 29 is a cross-section view of the package of FIG. 28.

Referring to FIGS. 24 and 25, another embodiment of the package 10 with contacting fluid-filled chambers is depicted. In this embodiment, the interlocking member 55*a* is disposed on an interior portion of front panel 12 between two distinct fluid-filled chambers 54*a* and 57*a*, and interlocking member 55*b* is disposed on an interior portion of the back panel 14 between two distinct fluid-filled chambers 54*b* and 57*b*. In this embodiment, the coupling of the interlocking members 55*a* and 55*b* holds the two pairs of chambers 54*a*, 54*b* and 57*a*, 57*b* in contact to form two interface areas 56. In this way, the sealing area may be doubled or otherwise increased. Referring to FIGS. 26-29, the package 10 is depicted using a tin-tie closure to hold chambers 54*a* and 54*b* in contact in an embodiment of the invention. The tin-tie closure can be of any such device known to a skilled artisan. A pair of flap portions 58*a* and 58*b* extend upward from the front and back panels 12 and 14, respectively and above the fluid-filled chambers 54*a* and 54*b*. A tin-tie 58*c* having ends that extend beyond the width of the package 10 in both directions may be disposed on an outer surface of the front panel 12 adjacent the chamber 54*a*.

In operation, the package 10 is closed by pressing the flap portions 58*a* and 58*b* together and folding them downward to form a crease or bend 58*d* that runs the width of the package 10. The flap portions 58*a* and 58*b* are held in the creased positions by folding the ends of the tin-tie 58*c* over the folded flap portions 58*a* and 58*b* or over or around the package. The chambers 54*a* and 54*b* may be held in contact by the crease 58*d* and retention applied by the force of the tin-tie.

In the above-described embodiments depicted in FIGS. 17-29, the interlocking members 55*a* and 55*b* need not provide sealing for the package 10. Rather, the integrity of the seal can be maintained by the various fluid-filled chambers 54*a*, 54*b* and/or 57*a*, 57*b*. The interlocking members 55*a* and 55*b* need only function to hold the fluid-filled chambers 54*a*, 54*b* and/or 57*a*, 57*b* in contact. Accordingly, the package 10 may continue to function properly even if the interlocking members 55*a*, 55*b* become damaged or become plastically deformed from repeated operation.

Figure 30:
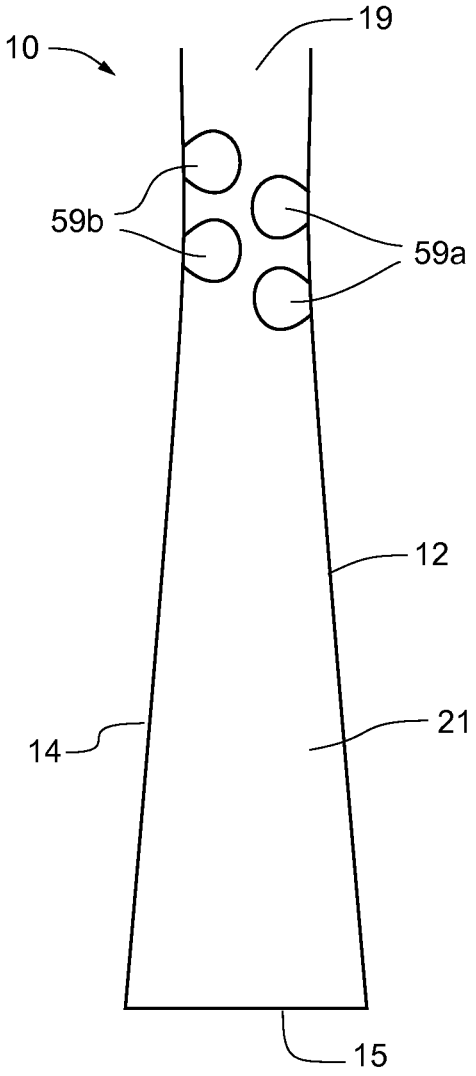
FIG. 30 is a cross-section view of a package in an open position with fluid-filled chambers that interlock for sealing in an embodiment of the invention.
Figure 31:
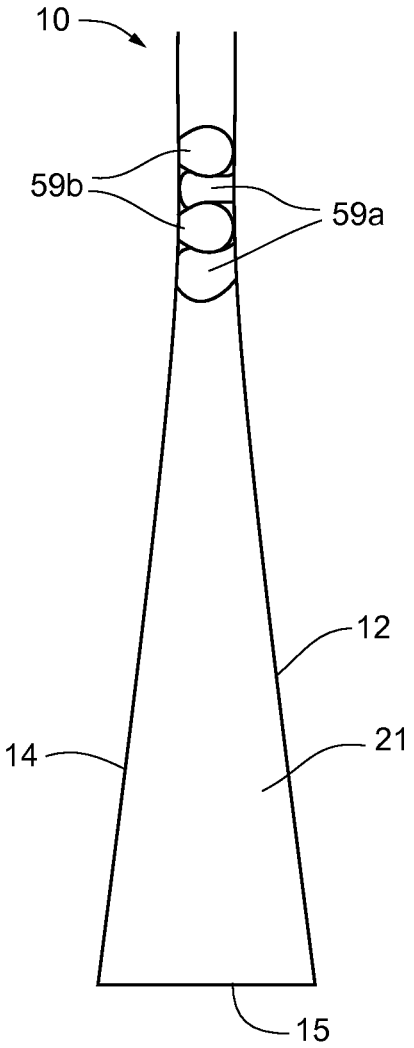
FIG. 31 is a cross-section view of the package of FIG. 30 in a closed position.

Referring to FIGS. 30 and 31, a package 10 including fluid-filled chambers 59*a* and 59*b* that interlock is depicted in an embodiment of the invention. Here, a plurality of distinct fluid-filled chambers 59*a* are formed on the front panel 12 and a plurality of distinct fluid-filled chambers 59*b* are formed on the back panel 14. The fluid-filled chambers 59*a*, 59*b* are shaped and positioned so that when the opening 19 is closed, the fluid-filled chambers 59*a*, 59*b* interlock. These chambers 59*a*, 59*b* can be taut or substantially filled with fluid to provide a semi-rigid or firm structure for interlocking. In a further embodiment, at least one of the chambers 59*a*, 59*b* may be replaced with a solid member (not depicted) shaped to engage with the opposing fluid-filled chamber and effect a seal. The solid member may be of a rigid or a flexible material.

Functionally, the interlocking of the fluid-filled chambers 59*a*, 59*b* serves to hold the fluid-filled chambers 59*a*, 59*b* in contact and thereby seal the package 10. In this embodiment, no additional structure is required to hold the fluid-filled chambers 59*a*, 59*b* in contact and maintain the seal. However, such closure structures as described herein could be implemented to further secure the contents of the package 10. For example, fastening means may be situated both above and below the fluid-filled chambers 59*a*, 59*b* to provide additional security while maintaining a symmetrical force on the interlocking fluid-filled chambers 59*a*, 59*b* (not depicted).

The embodiment of FIGS. 30 and 31 portrays two fluid-filled chambers on each of the opposing panels. The interlocking function may instead be affected by two fluid filled chambers on one panel (e.g. two fluid-filled chambers 59*a*) and one on the opposite panel that slips therebetween (e.g. only the lower fluid-filled chamber 59*b*). Likewise, the interlocking function may be affected by more than two fluid-filled chambers on each panel.

Figure 32:
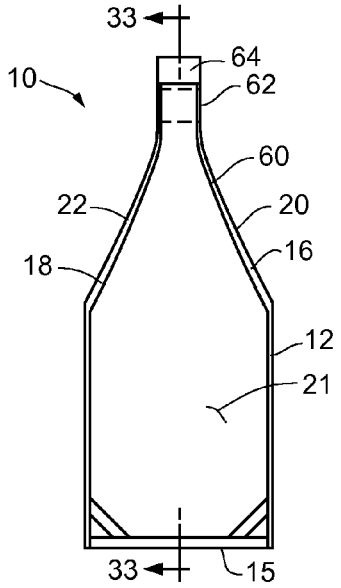
FIG. 32 is a front elevation view of a package with fluid-filled chambers that seal the throat of a funnel portion in an embodiment of the invention.
Figure 33:
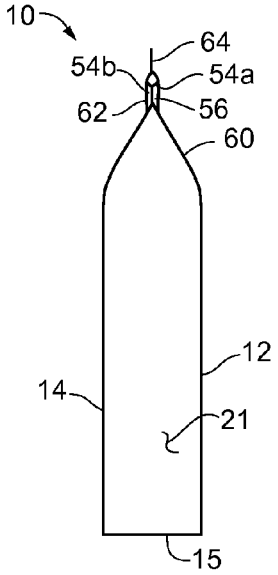
FIG. 33 is a cross-section view of the package of FIG. 32.
Figure 34:
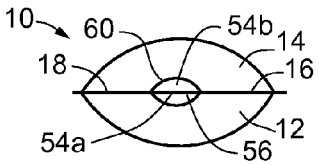
FIG. 34 is a top view of the package of FIG. 32.

Referring to FIGS. 32-34, the package 10 having a funnel or necking portion 60 is depicted in an embodiment of the invention. In the depicted embodiment, the necking portion 60 is defined by longitudinal edges 20, 22 and edge seals 16, 18 that converge to define a throat portion 62. The throat portion 62 includes the fluid-filled chambers 54*a* and 54*b* to form the interface area 56 therebetween. The fluid-filled chambers 54*a* and 54*b* may be integrally formed with and held in sealing contact by the throat portion 62.

Figure 33A:
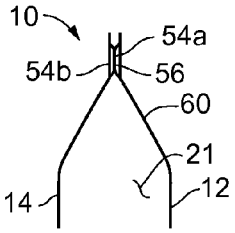
FIG. 33*a* is a partial cross-section view of the package of FIG. 32 with the top seal removed.
Figure 33B:
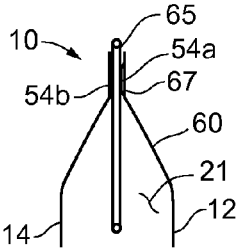
FIG. 33*b* is the partial cross-section view of FIG. 35 with a straw inserted.

A top seal 64 may be integrally formed with side seals 16 and 18 to initially seal the package 10. The top seal 64 (FIG. 33) may be removed by tearing or cutting. A conduit 65 such as a straw or tube may be inserted between the fluid-filled chambers 54*a* and 54*b* (FIG. 33*b*). When the opposing fluid-filled chambers 54*a* and 54*b* are utilized, the interface area 56 of the package 10 can serve to regulate or control the flow or exit of the contents from the package 10. Control of the flow may be accomplished by squeezing a portion of the package to force the contents (e.g. a fluid) through the interface area 56. The conduit 65 passing through the interface area 56 can further facilitate this regulation or access.

Figure 35A:
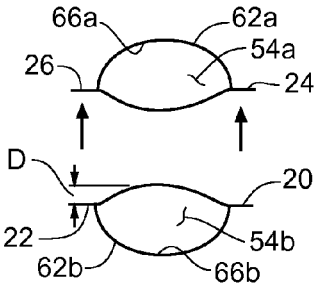
FIG. 35*a* is an exploded isolated view of a throat portion of a package in an embodiment of the invention.
Figure 35B:
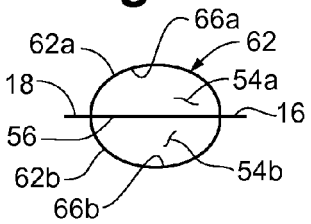
FIG. 35*b* is a view of an assembled throat portion of FIG. 35*a;*

Referring to FIGS. 35*a* and 35*b*, the throat portion 62 may be formed from two halves 62*a* and 62*b* that define recesses 66*a* and 66*b*, respectively. The fluid-filled chambers 54*a* and 54*b* are operatively coupled with the respective halves 62*a* and 62*b* of the throat portion 62. The fluid-filled chambers 54*a* and 54*b* may be sized to protrude away from the respective recesses 66*a* and 66*b* at a distance D (FIG. 35*a*). Upon joining the first and second front longitudinal edges 20 and 22 to the first and second back longitudinal edges 24 and 26 to form seams 16 and 18, the fluid-filled chambers 54*a* and 54*b* are compressed into the recesses 66*a* and 66*b* of halves 62*a* and 62*b* (FIG. 35*b*).

Figure 36:
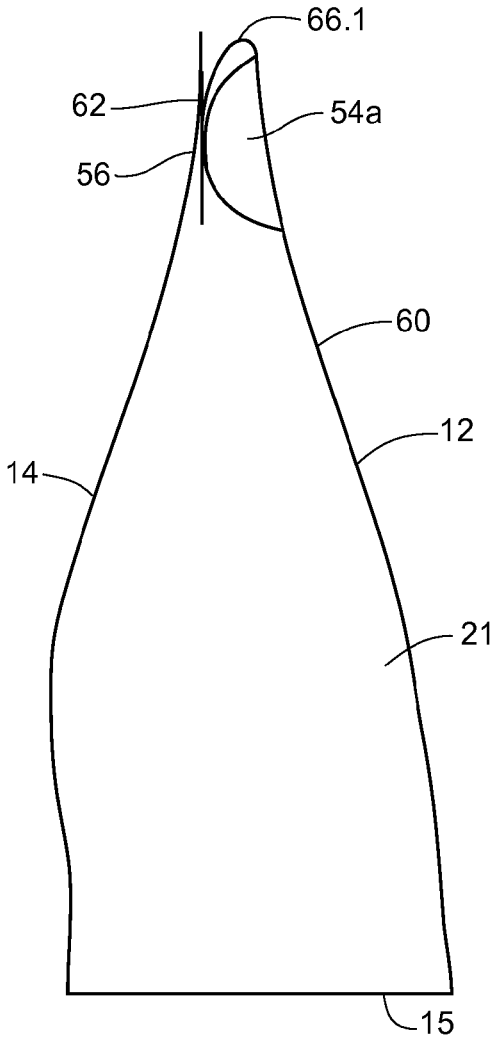
FIG. 36 is a cross-section of a single fluid-filled chamber having a protective flap in an embodiment of the invention.
Figure 36A:
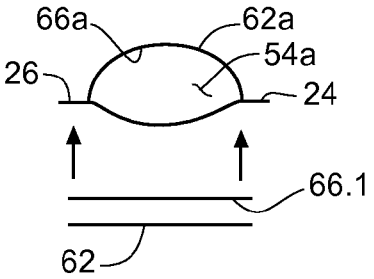
FIG. 36*a* is an exploded isolated view of a throat portion of FIG. 36.
Figure 36B:
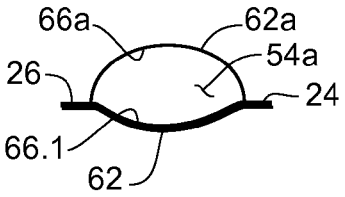
FIG. 36*b* is a view of an assembled throat portion of FIG. 36*a;*
Figure 37:
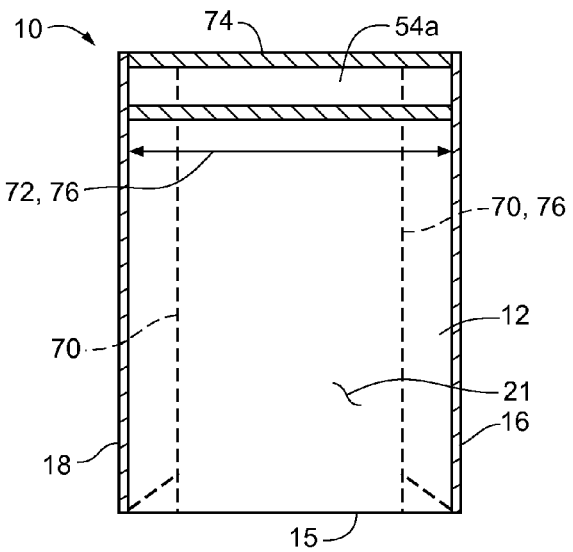
FIG. 37 is a front elevation view of a package with gusseted sides in an embodiment of the invention.
Figure 38:
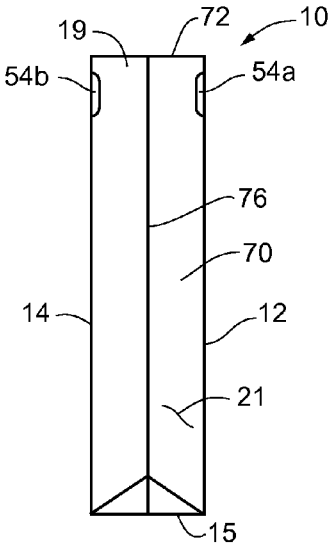
FIG. 38 is a side elevation view of the package of FIG. 37 in an open position.
Figure 39:
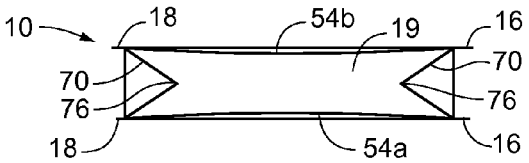
FIG. 39 is a top view of the package of FIG. 37 in an open position.
Figure 40:
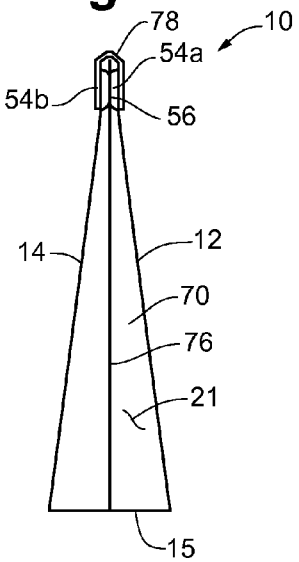
FIG. 40 is a side elevation view of the package of FIG. 37 in a closed position.
Figure 41:
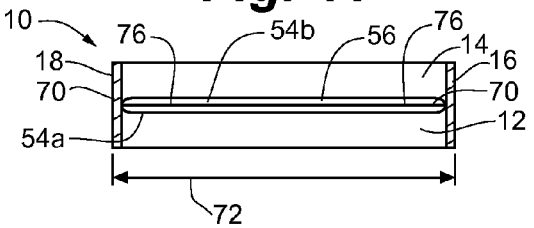
FIG. 41 is a top view of the package of FIG. 37 in a closed position.
Figure 42C:
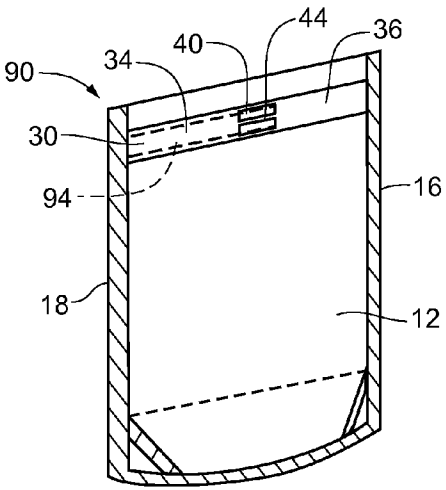
FIGS. 42*a*-42*c* are perspective views of a consumer filled flexible package with a fluid actuated closure mechanism in an embodiment of the invention.
Figure 42B:
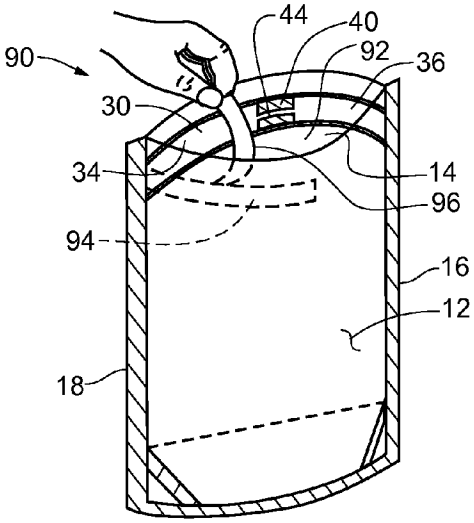
Figure 42A:
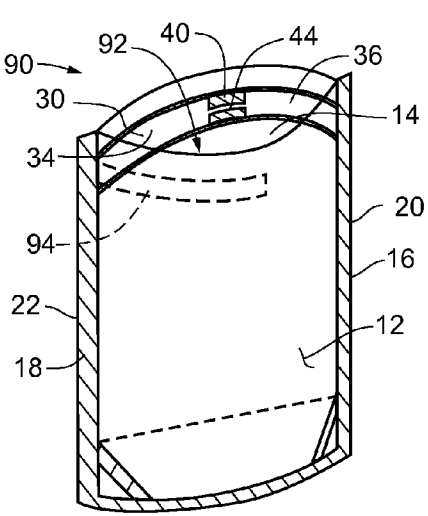
Figure 42E:
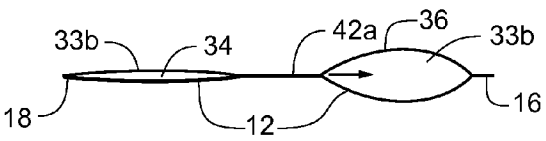
FIG. 42*e* is a sectional view of the closure mechanism of FIG. 42*c* with the fluid actuated closure in a closed position.
Figure 42D:
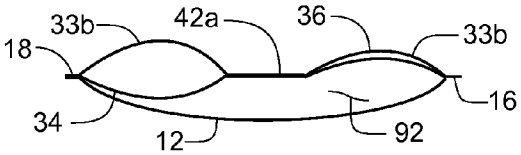
FIG. 42*d* is a sectional view of the closure mechanism of FIG. 42*a* with the fluid actuated closure mechanism in an opened or deflated state.

Referring to FIGS. 36, 36*a* and 36*b*, only the single fluid-filled chamber 54*a* is utilized in the throat portion 62 to effect the sealing interface 56 in an embodiment of the invention. The throat portion 62 and the single fluid-filled chamber 54*a* cooperate to form the interface area 56 therebetween, as shown in FIG. 36. The throat portion 62 may generally comply with the contour of the fluid-filled chamber 54*a*, thus mitigating against the formation of creases that may cause a leak path through the sealing interface 56.

A protective film or flap 66.1 may be included that shrouds at least a portion of an exterior surface of the single fluid-filled chamber 54*a* and extends interstitially between the fluid-filled chamber 54*a* and the throat portion 62. Such a configuration would include two sealing surfaces 56—one between the flap 66.1 and the fluid-filled chamber 54*a*, the other between the flap 66.1 and the throat 62.

In other embodiments of the invention, a throat-shaped portion is not required and the interface area 56 can be configured for any known package 10 design to provide regulation of contents out of, or access into the package through the opening, whether by two opposing fluid chambers or by a single fluid chamber in cooperation with an opposing member.

In operation, the top seal 64 may provide a secure seal that ensures the retention of the contents and the integrity of package 10 during shipping and handling. The contents of package 10 may be extracted by tearing off or cutting off the top seal 64 (FIG. 35) and causing an internal pressure that separates the members defining the interface area 56 for selective breaching thereof, enabling the contents of the package 10 to flow therethrough. The contents may also be removed through the conduit 65, for example by applying a suction force on the conduit 65 or by applying pressure to the package 10 that forces the contents through the conduit 65.

When utilized, the flap 66.1 may serve to protect the fluid-filled chamber 54*a* against puncture when inserting the conduit 65 or against other elements that may puncture the fluid-filled chamber 54*a*.

The contact pressure of the interface area 56 may be tailored during the formation of the throat portion 62 and fluid-filled chambers 54*a* and 54*b* so that the internal pressure required to separate the fluid-filled chambers 54*a* and 54*b* meets a specified criterion. The pressure at the interface area 56 as formed above is a function of several parameters, including the pressure and compressibility of the fluid within the fluid-filled chamber(s) 54*a*, 54*b*, the dimension D of the protrusion away from the recesses, and the thickness and stiffness (modulus of elasticity) of the materials that comprise the throat portion 62 and the fluid-filled chamber(s) 54*a*, 54*b*. For example, the fluid-filled chamber(s) 54*a*, 54*b* may be filled with a compressible gas such as air and have a wall thickness from 0.002- to 0.004-inches. A non-limiting and representative dimension D is on the order of 0.25-in. Higher internal pressures and greater protrusions D may tend to increase the pressure of the interface area 56, as may greater thickness and stiffness of the throat portion 62 and the fluid-filled chambers 54*a* and 54*b*.

Accordingly, in one embodiment, the contact pressure may be tailored to enable flow of the contents due merely to the initial hydrostatic forces caused when the package 10 is tipped on end (i.e. with the throat portion 62 positioned below the contents of the package 10). In another embodiment, the contact pressure may be increased so that the interface area 56 is maintained regardless of the orientation of the package, thus requiring an additional pressure be applied to the inner cavity 21 for the contents to flow out, such as by squeezing or shaking the package 10.

The fluid-filled chamber(s) 54*a* and/or 54*b* may also be tailored to substantially provide a seal 67 between the inner cavity 21 and the exterior surface of the conduit 65. The conduit may be used to inject or extract the contents of the package 10. The seal 67 may limit leaking or spilling of the contents of package 10 through the throat portion 62, even when the conduit 65 is in place, for example in where the user is engaged in a rigorous activity (e.g. walking, biking or jogging) or in situations where the user is unskillful (e.g. a toddler, handicapped or aged person). The seal 67 may also limit exposure of the contents of the inner cavity 21 to the ambient atmosphere compared to a configuration where the throat is simply open to atmosphere. The fluid-filled chambers 54*a* and 54*b* may also provide automatic sealing of the package 10 upon removal of the conduit 65, thereby limiting contamination and spilling of the contents of package 10 when the conduit 65 is not in place.

Referring to FIGS. 37-41, the package 10 that utilizes gusseted sides 70 is depicted in another embodiment of the invention. The fluid-filled chambers 54*a* and 54*b* located on opposing front and back panels 12 and 14 and extending along an internal width 72 of the package 10 may be positioned near a top end 74 of the package 10 such that when the package 10 is closed, the fluid-filled chambers 54*a* and 54*b* contact each other to define the interface area 56. In the embodiment depicted, each of the gusseted sides 70 are characterized by a crease 76 that extends between the fluid-filled chambers 54*a* and 54*b* to proximate the top end 74 of the package 10.

In the depicted embodiment, a clip 78 can be placed over the top end 74 of the closed package 10 to maintain the fluid-filled chambers 54*a* and 54*b* in the closed position. Other fastening means may be utilized, such as tape, tin ties or the like.

In the open position (FIGS. 37-39), the gusseted sides 70 may be in an extended or semi-extended position that enables the fluid-filled chambers 54*a* and 54*b* to remain substantially parallel to each other in the open position. In the closed position (FIGS. 40 and 41), the gusseted sides 70 are in a folded position with the creases 76 pinched between the fluid-filled chambers 54*a* and 54*b*. In this embodiment, the package 10 is sealed near the ends of the fluid-filled chambers 54*a* and 54*b* by registering against the folded gusseted sides 70 pinched therebetween.

Functionally, the gusseted sides 70 provide a greater access opening to the internal cavity 21, enabling larger objects to be placed therein with greater ease, and full expansion of the package provided by the gussets. The interface area 56, when formed between the fluid-filled chambers 54*a* and 54*b* and between the fluid filled chambers

54*a*, 54*b* and the gusseted sides 70 in the pinched position, may isolate the cavity 21 from ambient atmosphere and prevent accidental spilling of the contents of the package 10.

Any of the fluid-filled chambers described herein can be constructed of multiple smaller pockets to define the larger chamber. Further, the fluid chambers can be separately applied to the package panels or integrally formed with the package (e.g., by folding a top or edge portion of the package onto itself), and could run the machine direction of the pouch or at other angles or directions. Additionally, the chambers and other devices could be applied during package formation or at any other time after the package is formed. Moreover, the fluid chambers may be applied to flexible, semi-rigid, or rigid packages, or a combination of such materials, to provide the sealing and closure structures and functions disclosed herein.

Referring to FIGS. 42A through 42E, a user filled flexible package 90 having an opening 92 in combination with the fluid actuated closure 30 is depicted in an embodiment of the invention. The user filled flexible package 90 may include at least one fluid actuated closure 30 attached to the front or back panel 12 or 14 of the flexible package 90. In one embodiment, the user filled flexible package 90 includes a two-sided tape 94, one side of which being adhered to the interior of the flexible package (e.g. to the font panel 12) and the other side being shielded by a release liner 96. The two-sided tape 94 may be adhered to a portion of the front panel 12 opposite the fluid actuated closure 30 as depicted. The two-sided tape may span the area of the fluid actuated closure 30 that includes the reservoir portion 34 and the restriction channel 44 or fluid regulator 40. Other known closure techniques and methods can be used instead of the tape 94 without deviating from the spirit and scope of the present invention.

In operation, the end user can open the entire or a substantial portion of the length of the opening 92 for placement of articles in the flexible package 90. After placement of the articles within the package 10, the end user can peal the release liner 96 off of the two-sided tape 94 and press the front and back panels 12 and 14 together causing the exposed inward face of the two-sided tape 94 to adhere to the reservoir portion 34 and the portion housing the restriction channel 44 or fluid regulator 40 of the fluid actuated closure 30. The two-sided tape 94 provides a seal between the front panel 12 and the reservoir portion 34/fluid regulator 44 portion. The fluid chamber 33*b* of the closure portion 36 may cooperate with the front panel 12 to provide a selective seal. The user can apply pressure to transfer the fluid between the reservoir portion 34 and the closure portion 36 to provide selective access into the cavity or to regulate material exiting or entering the package 10 through the access opening 92.

In another embodiment, designed to regulate material exiting or entering the package 10, the fluid may reside in the closure portion 36 only, confronting the opposing package side such as described attendant to FIGS. 32-36. In such an embodiment, the package 10 can be squeezed such that the contents of the package 10, e.g., fluid, is controllably released or forced out of the package 10, thus selectively breaching the interface area 56. In still another embodiment, with other embodiments described herein, two opposing fluid filled chambers 54*a*, 54*b* can be configured with the opening 92 as well.

The two-sided tape 94 may include an aggressive adhesive that renders an essentially permanent seal between the two-sided tape 94 and the sealed portion of the fluid actuated closure 30. Alternatively, the adhesive may be less aggressive, enabling the user to re-open the opening 92 and refill the flexible package therethrough several times. Sealing means other than the two-sided tape 94 can also be used with the user filled flexible package 90, such as zippers, pinch locks, hook and loop materials (e.g. VELCRO) and other sealing means available to the artisan. Whatever sealing means is used could be applied during the manufacturing of the package, or as a side operation before being placed on the market. It may even be sold as a kit, compete with instructions provided on a tangible medium for the consumer to apply the sealing means to the package themselves.

Figure 43A:
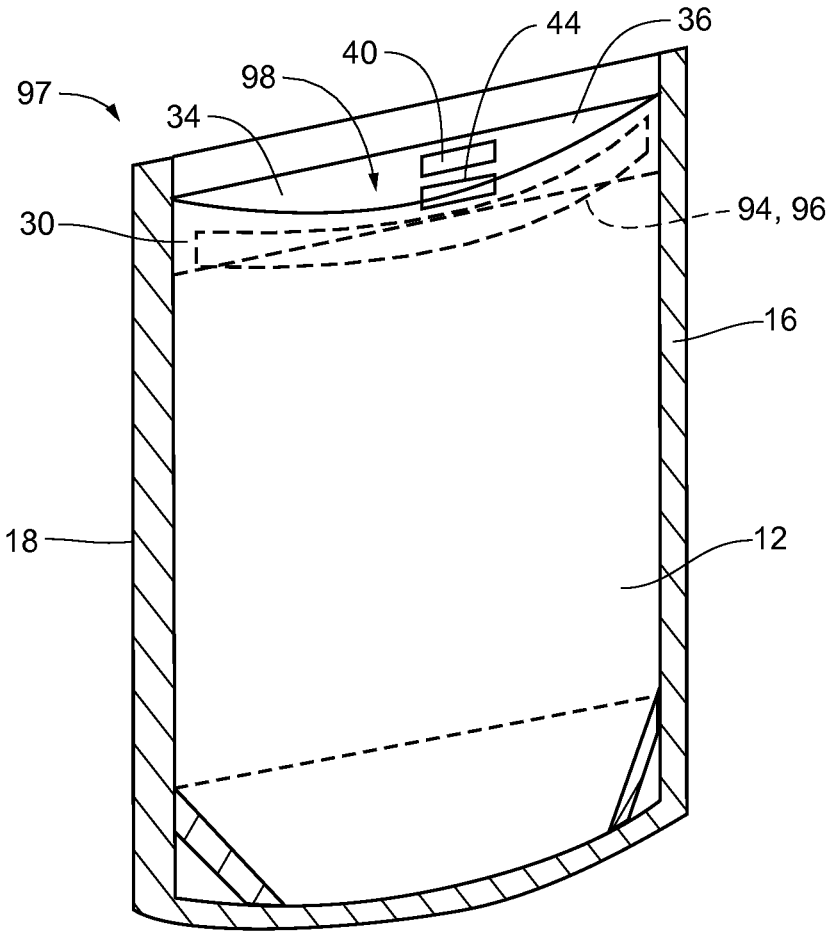
FIG. 43*a* is a perspective view of a flexible package having a fluid actuated closure mechanism in the closed position and an auxiliary access in an embodiment of the invention.
Figure 43B:
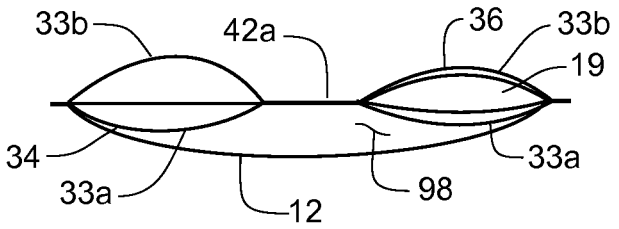
FIG. 43*b* is a top view of the flexible package of FIG. 43*a* with the fluid actuated closure in an open position.

Referring to FIGS. 43A and 43B, a flexible package 97 having an auxiliary access 98 is depicted in an embodiment of the invention. This embodiment is contrasted from the embodiment of FIGS. 42A-42E in that includes the dual fluid-filled chambers 33*a* and 33*b* and the auxiliary access 98 is distinct from the access opening 92. Accordingly, the two-sided tape 94 transverses substantially the length of the auxiliary access 98 for sealing the auxiliary access 98.

While FIG. 43A depicts the two-sided tape 94 for sealing, a variety of sealing means could be utilized, including but not limited to an adhesive, zippers, pinch locks, hook and loop materials.

The user filled flexible packages 90, 97 can be sold to the consumer empty. The consumer could, as with user filled packages (e.g. ZIP-LOC packages), purchase a number of the flexible packages 90 to store whatever products or articles they wish.

Referring to FIGS. 44A through 44E, a metered flexible package 100 including a main compartment 102 and a metered compartment 104 connected by a passageway 105 is depicted in an embodiment of the invention. The boundary between the main compartment 102 and the metered compartment 104 may be defined by one of the various fluid-filled chamber devices herein described, such as the single fluid filled chamber 54*a* disposed in the passageway 105 that cooperates with an opposing member 106 to define the interface area 56 (depicted) for sealing in the passageway 105. The metered flexible package 100 may include a handle portion 108.

The metered compartment 104 is so named because it may be sized to contain a quantity of product to within a known or acceptable uncertainty. The main compartment 102 may neck down to a throat portion 110 at the passageway 105. A selectively sealable closure 114 such as a pinch-lock seal (depicted) may be located at a distal end portion 116 of the metered chamber 104. The metered chamber 104 may also include vents 118 such as slots or perforations that enable air to pass between the metered chamber 104 and the ambient surroundings.

Figure 44A:
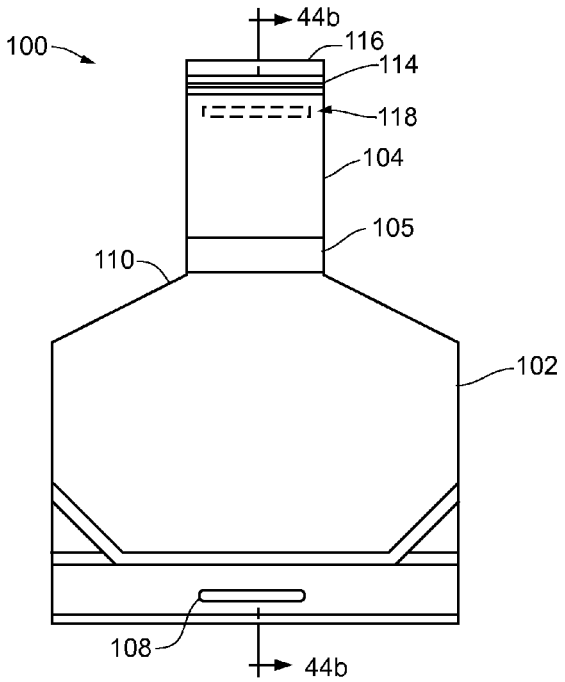
FIG. 44*a* is a front elevation view of a flexible package having a metered chamber in an embodiment of the invention.
Figure 44B:
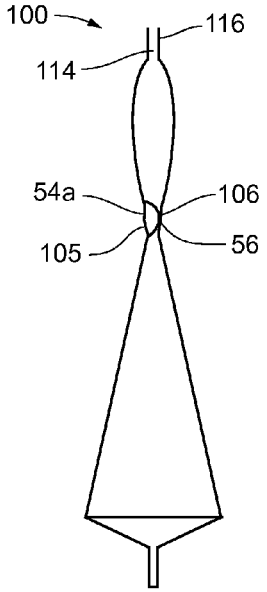
FIG. 44*b* is a side elevation view of the flexible package of FIG. 44*a;*
Figure 44C:
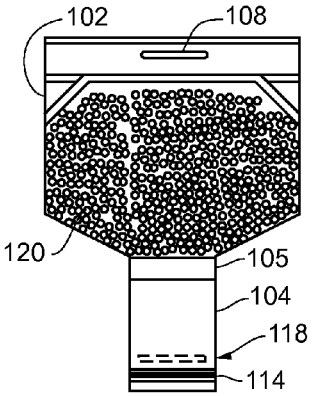
FIGS. 44*c* through 44*e* depict use of the flexible package of FIG. 44*a;*
Figure 44D:
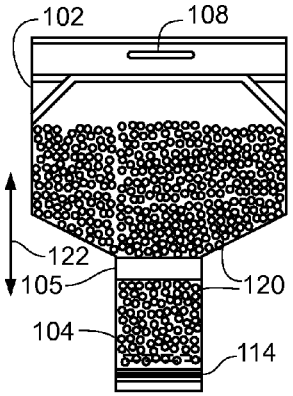
Figure 44E:
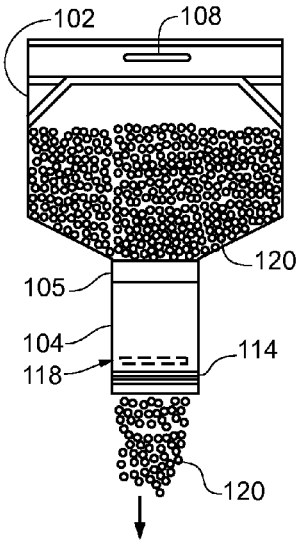

In use, the user orients the metered flexible package 100 containing a product 120 so that the metered chamber 104 is below the main chamber 102 (FIG. 44C). The user can shake the metered package 100, depicted by the up/down arrow 122. The shaking technique may be particularly effective for pellet-type products such as dry dog food. The down motions of the shaking motion 122 may cause a portion of the product 120 to breach the interface area 56 from the main chamber 102 into the metered chamber 104. The vents 118, when present, enable air that is displaced by the product 120 entering the metered chamber 104 to be pushed out of the metered chamber 104 while still containing the product 120. This process may continue until the metered chamber 104 is filled. When the metered chamber 104 is filled, the quantity of product 120 within the metered chamber is known to within an acceptable uncertainty. The user may then open the selectively sealable closure 114 to pour out the product 120 in the metered chamber 104.

Passage of product between the chambers 102, 104 of the metered flexible package 100 fluids may also be accomplished by squeezing one of the chambers 102, 104 so as to transfer product in to the metered chamber 104. Such and approach would be particularly suitable where the squeezed chamber contains a liquid. The concept of the metered flexible package 100 may be extended to include mixing of products located in adjacent chambers and separated by the fluid chamber closure (e.g. mixing two liquids or mixing a liquid with a granular product).

Figure 47:
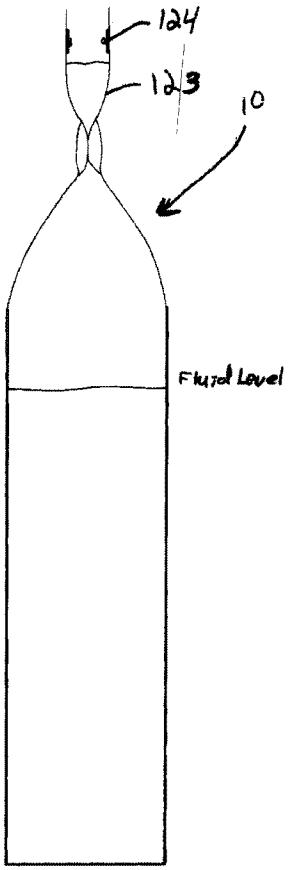
FIG. 47 is a cross-sectional view showing the package of FIG. 45 after compression is removed.
Figure 46:
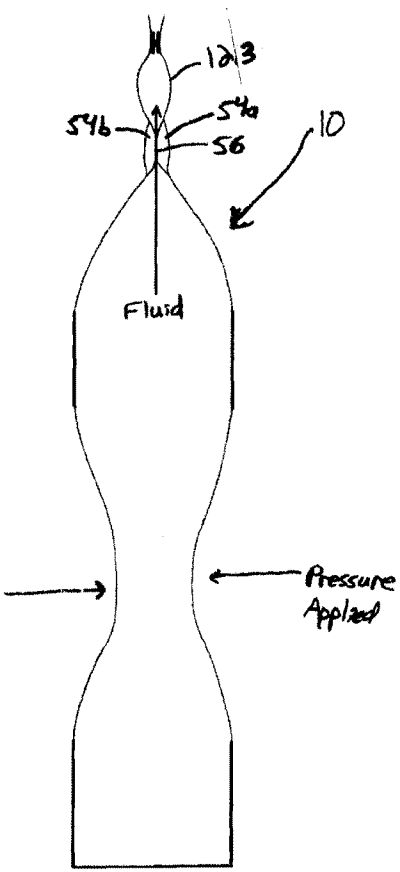
FIG. 46 is a cross-sectional view showing the package of FIG. 45 being compressed.
Figure 45:
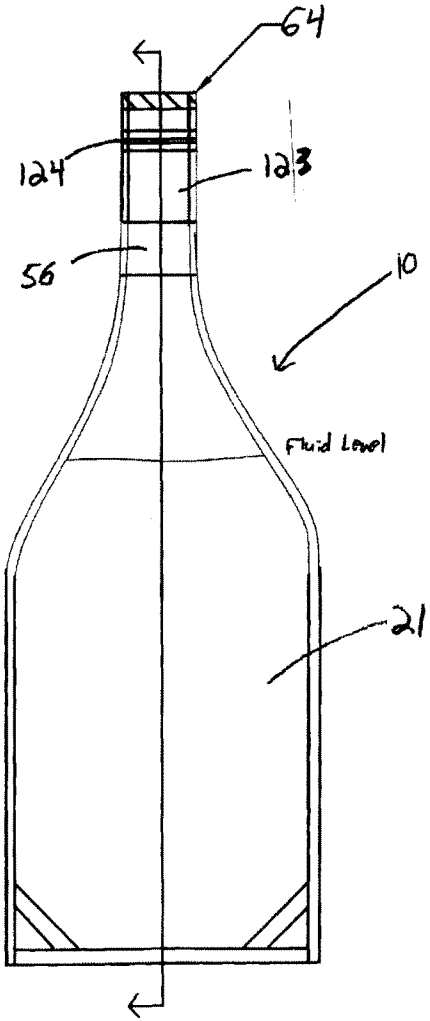
FIG. 45 is an elevation view of a package according to an additional example embodiment.

Referring to FIGS. 45-47, an additional embodiment of a metering flexible package 10 is shown. A metering chamber 123 is formed between the interface area 56 and a re-sealable closure 124. A top seal 64 can be provided adjacent to the re-sealable closure 124.

In use, a user can squeeze the body of the package 10 as shown in FIG. 46, thereby increasing the pressure in the inner cavity 21 above the sealing threshold of the fluid filled chambers 54*a* and 54*b*. As a result, the fluid contents of the package 10, such as a liquid, is caused to travel through the interference area 56 as indicated by the arrow and fill the metering chamber 123. The amount of contents caused to fill the metering chamber 123 can be controlled by the user by selectively varying the pressure applied to the package 10 body. One or more portions of the package 10 can be shaped or sized to facilitate pressure application. In various embodiments, a single chamber or bubble 54*a* can be used with the metering package, rather than two chamber 54*a*, 54*b*. As such, the single bubble 54*a* opposes a the inside surface of the opposing panel or some other opposing structure of the package 10, or a structure provided with the package 10.

The fluid in the metering chamber 123 does not flow back into the inner cavity 21 due to the sealing function of the fluid filled chambers 54*a* and 54*b* at the interface area 56. The user can open the re-sealable closure 124 and then consume, dispense or pour the metered amount of fluid from the package as shown in FIG. 47. After emptying the metered chamber 123, the re-sealable closure can be sealed again. The closure 124 can be of a construct enabling it to withstand substantial pressure from the interior contents without forceably opening, while still remaining easily openable by a user via pulling apart of the zipper engagements or profiles from the outside. The re-sealable closure may also be omitted from the present embodiment depending on the desired usage. The size and shape of the metering chamber 123 can vary greatly with respect to the size and shape of the remainder of the package 10.

In an additional embodiment, the flexible package may be provided with multiple inner chambers that are each in fluid communication with the metering chamber. In such embodiments, the contents of the chambers will mix in the metering chamber when pressure is applied to the package sufficient to force the fluid contents in the inner chambers up into the metering chamber.

The use of a re-sealable closure 124 has the additional benefit of reducing the likelihood that a user will over-fill the metering chamber 123 and spill the package contents. To employ this feature, the user fills the metering chamber 123 with the re-sealable closure 124 in the closed position. The re-sealable closure is then opened for dispensing or use.

The metering chamber 123 may be formed from the same material as the rest of the package, or of a different material. For example, the metering chamber 123 may be of a more rigid material that can hold a cup-like shape. Measurement markings or other indicia can also be provided to the metering chamber 123 to permit the user to dispense a measured quantity of package contents. Such markings are particularly useful for dispensing liquid medicines or liquids used in cooking. A conduit, indent or thermoformed portion (not shown) can also be provided at or proximate the interface area 56 with the present embodiment as described with regard to FIG. 33*b*, for example, to facilitate fluid travel, reduce the level of pressure required to move the fluid, and the like. It may be desired in certain applications for the metering chamber 123 to be transparent or translucent, so that the user can see the amount of contents filling the metering chamber 123, while some or all of the remainder of the package may be opaque so that light does not degrade the package contents.

Figure 48:
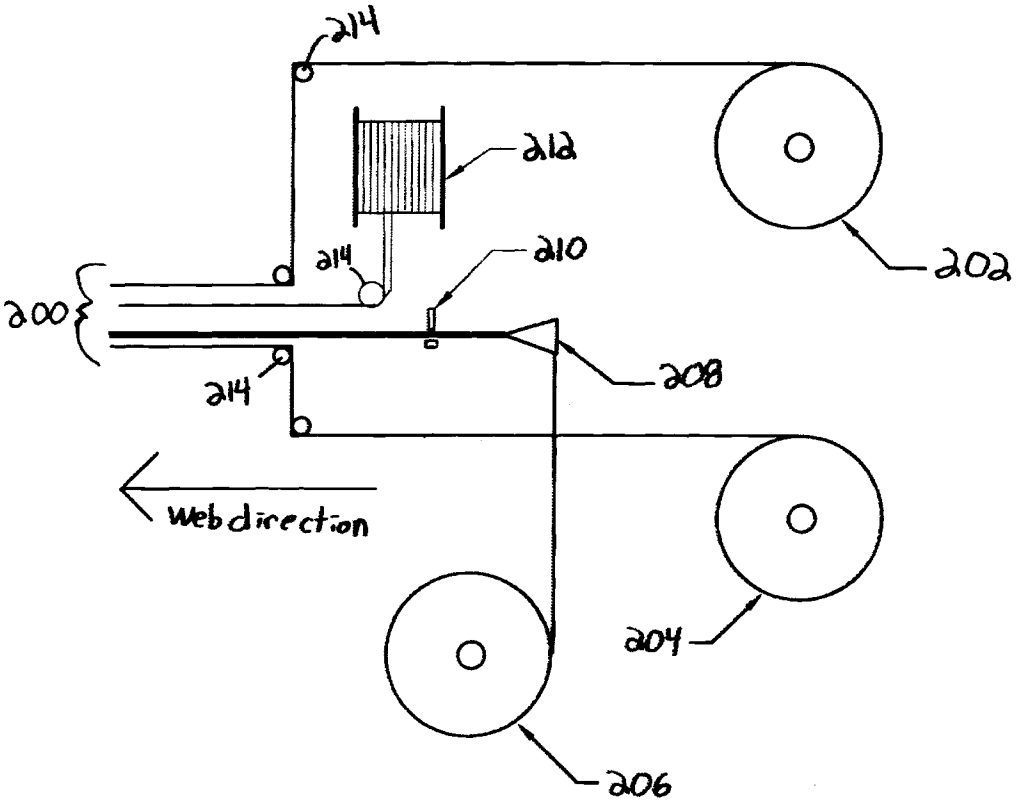
FIG. 48 is a side-view diagram of a flexible package manufacturing or formation process and componentry according to an example embodiment.
Figure 49:
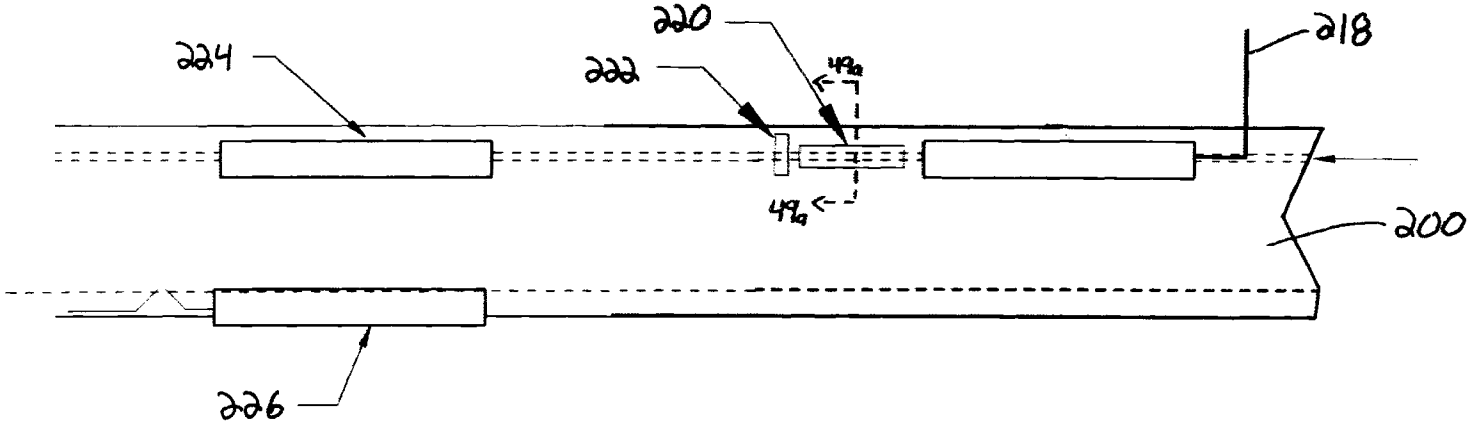
FIG. 49 is a diagram of a flexible package manufacturing or formation process and componentry according to an example embodiment.
Figure 49A:
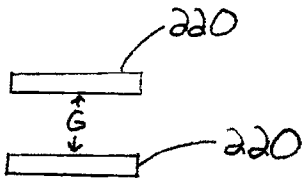
FIG. 49*a* is a cross-sectional view of a portion of the diagram of FIG. 49.
Figure 50:
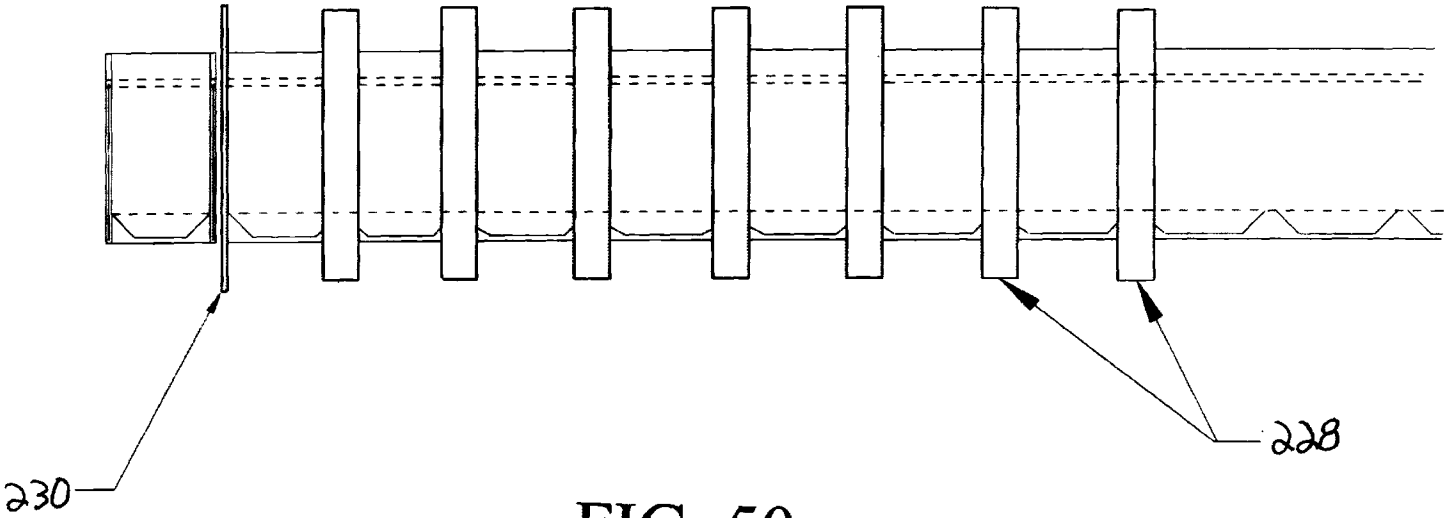
FIG. 50 is a diagram of a flexible package manufacturing process and componentry according to an example embodiment.
Figure 51:
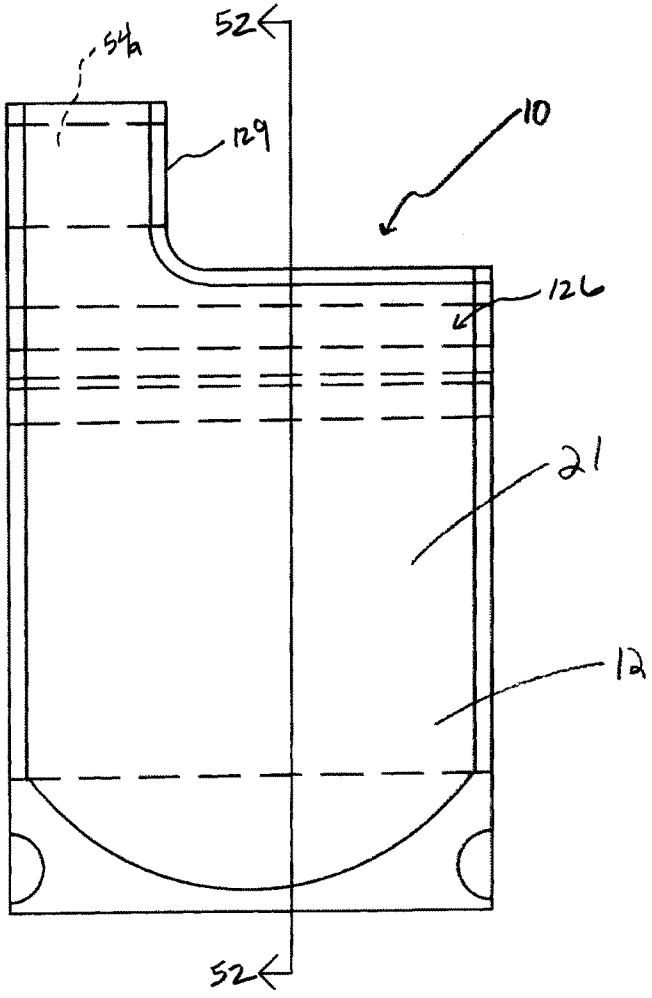
FIG. 51 is a front view of a flexible package according to an additional example embodiment.
Figure 52:
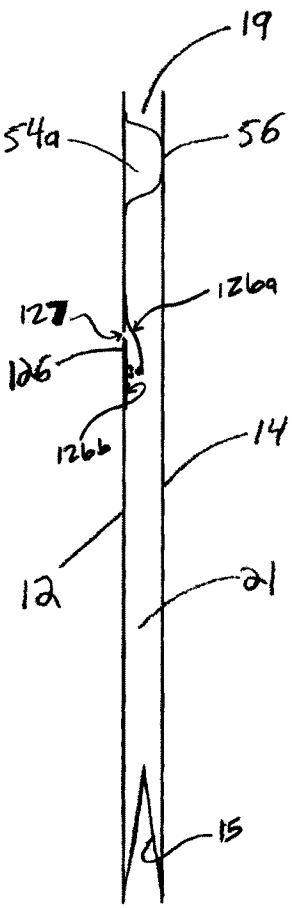
FIG. 52 is a side sectional view of the flexible package of FIG. 51, taken along line 52-52.
Figure 54:
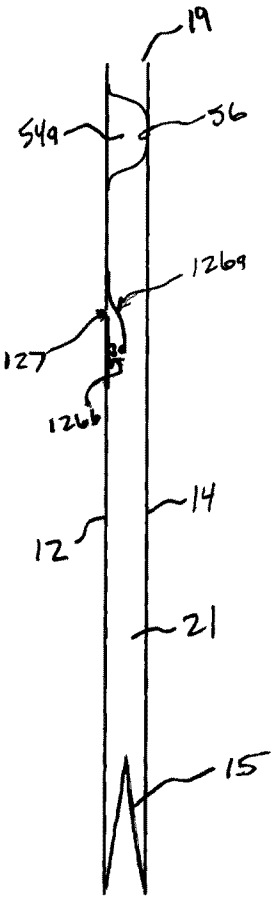
FIG. 54 is a side sectional view of the flexible package of FIG. 53, take along line 54-54.
Figure 53:
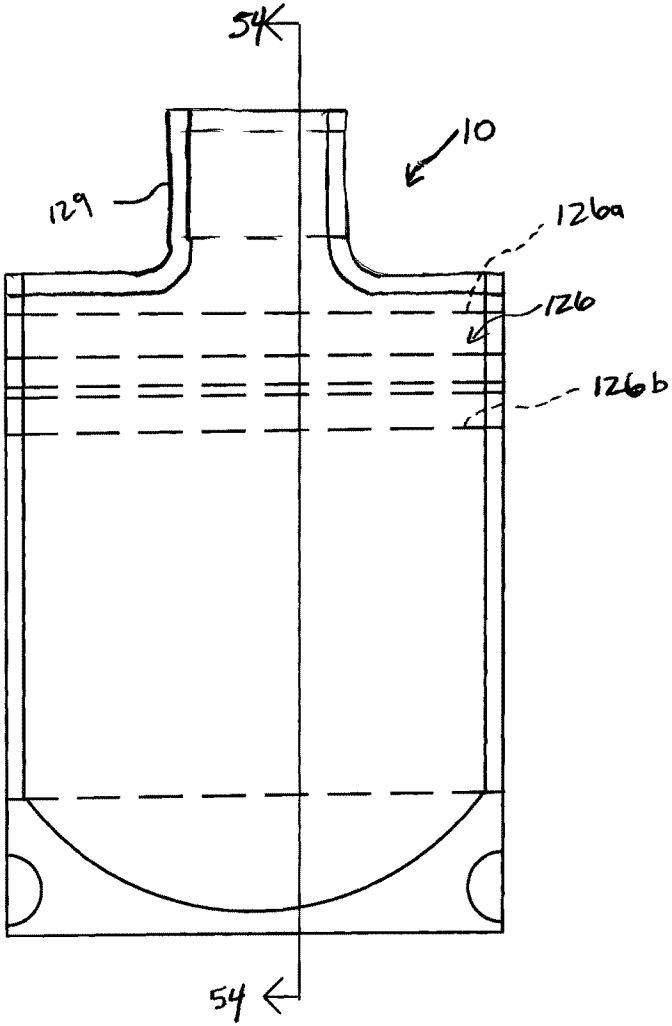
FIG. 53 is a front view of a flexible package according to an additional example embodiment.

Referring to FIGS. 48-50, the process of forming a flexible package of the present invention will now be described—e.g., to form a stationary or fixed bubble or fluid closure. A main web 200, can be used to make the front, back, and sometimes the bottom of a single-web stand-up pouch. Alternatively, multiple web materials can be used to form the package and the main web 200. In one embodiment, the panels or web materials are fed into the pouch machine from the back film unwind station (202 and/or 204) as illustrated in FIG. 48. Front panel roll 202 can contain the material to form the front panel. Back panel roll 204 can contain the material to form the back panel of the package. Bottom roll 206 can contain the material to form a bottom gusset of the package. The bottom gusset material travels through a folding station 208 and is punched by a gusset hole punch 210 before joining up with the other material portions in the main web. A roll of material 212 (e.g., to form the bubble or fluid closure) may be provided and fed through for the package configuration. A plurality of rollers 214 are provided to direct, rotate and re-direct the various material components as desired.

The web of material 200 is manipulated through the machinery to turn the sealant side of the structure inward, so the pouch material has the sealant side inside of the pouch for making heat seals later in the process. This can be done by slitting the film in the machine, and separating the front and back panel from each other prior to turning them with the sealant side facing inward, or by folding the web to accomplish this same result. Alternatively, the web materials can be selectively fed through the machine such that the sealant surfaces are generally facing one another.

The front and back web material is separated enough to allow the additional narrower web of material 212 to be directed in between them, preferably near the top of the pouch to be made. This narrower web will be used to form the fluid filled chambers or bubble-closure.

Referring to FIG. 49, a plate, or other thin non-sealable material, is placed between the front panel of the film and the bubble closure web and back web to allow the narrow bubble web to be sealed to the back panel without sealing to the front panel. At this location, a long tube or rod 218 is placed between the bubble material and back panel material that will carry the air to inflate the bubble material. A set of longitudinal seal bars is then used to seal the narrow bubble material along its outer edges, on each side of the air-loaded tube 218, to seal it down to the back panel.

A continuous flow of air is sent through the tube 218 to inflate the bubble material that has just been formed into a continuous tube down the length of the back panel. The long continuous bubble is then fed through a series of plates 220 that have a particular gap or spacing G between them which only allows an inflated bubble past them which is equal to greater than the height of the gap G between the plates. Any air that cannot fit between the plates is pushed back through the just formed bubble material and exits the pouch where the air-loaded tube 218 was fed in.

As the bubble exits the series of plates 220, one or more small seal bars 222 can seal the continuous bubble into segmented bubbles, if desired. In one embodiment, the otherwise continuous bubble can be sealed multiple times closer and closer to one of the edges, or the access opening area, to push the bubbled air and define the bubble at or proximate the access opening of the package. This will define the length or width of the bubble and can facilitate providing the bubble with the desired level of fluid and pressure therein. In some cases, a double seal is made so that two separate bubbles are made. In this case, one bubble can be deflated later in the process, leaving the defined bubble closure with the desired fluid and pressure. This is done when a certain minimal amount of air is required in order to regulate it properly with the plates.

The webs are then carried through a second longitudinal sealing section where yet another thin plate or other thin non-sealable material is placed between the front panel and the back and tube/bubble material near the top of the pouch section to keep them from sealing together. A longitudinal seal bar 224 is used to start to seal part of the newly formed bubble segments down, which will force the air from one side of the bubble to the other side. This process completely seals the narrow bubble material down to the back panel and creates a higher amount of air pressure in the section of the bubble that remains. This is done to end up with a narrower bubble than the total width of the completed pouch and to achieve the right amount of required pressure in the completed bubble to contain the product of the finished pouches. This also allows for a section, gap or opening along side of the formed bubble, for the product to be filled into the pouch without having to pass through the bubble section. An additional longitudinal seal bar 226 is used to seal the bottom of the pouch, or bottom gusset web, if a stand-up pouch is being made.

Referring to FIG. 50, the webs of material then pass through a cross-seal section of the machine 228 where the side seals of the pouch are made. This is also the typical station where any shaped seals are made for shaped pouches.

Finally, the pouches pass through a guillotine knife system 230, or a die cutter system for shaped pouches, to cut each pouch off and separate them from the main web.

These pouches can have either mechanical perforations, slits, or preferably laser scores, along the tops of them, above the bubble, for the consumer to later tear off the top seal which is typically made after the pouch is filled with product.

Similar to the forming process of FIGS. 48-50, the package can be formed with one or more re-closeable bubble or fluid actuated closures (e.g., including reservoir and closure portions). The initial steps can be identical or similar, in whole or in part, to the above-identified package formation processes for a fixed bubble or fluid closure. However, as the bubble exits the series of plates and a small seal bar seals the continuous bubble into segmented bubbles that can be the length of the finished pouch width, the webs are then carried through a second longitudinal sealing section where yet another thin plate or other thin non-sealable material is placed between the front panel and the back and tube/bubble material near the top of the pouch section to keep them from sealing together. A cross seal is made between the back panel and the bubble material anywhere between what will later be the side seals, although preferably about midpoint of the width of the pouch or bubble. This cross seal can serve to divide a single bubble into multiple bubble portions. The seal can include a channel (e.g., defined or shaped in a seal plate or bar) through it that will allow a certain amount of air to travel from one side of the bubble to the other (e.g., communication from closure to reservoir portions). As disclosed herein, the channel can provide communication between the various bubble or bubble portions of the fluid chambers. The channel in the seal can be made in different sizes and shapes to make the air flow easier or harder from one side to the other (e.g., zig-zag, straight, thick, thin, undulating, and like designs, shapes or sizes). An additional longitudinal seal bar is used to seal the bottom of the pouch, or bottom gusset web, if a stand-up pouch is being made.

The webs of material then pass through a cross-seal section of the machine where the side seals of the pouch are made. This is also the typical station where any shaped seals are made for shaped pouches.

Finally, the pouches pass through a guillotine knife system, or a die cutter system for shaped pouches, to cut each pouch off and separate them from the main web.

These pouches can have either mechanical perforations, slits, or preferably laser scores, along the tops of them, above the bubble, for the consumer to later tear off the top seal which is typically made after the pouch is filled with product.

Referring to FIGS. 51-58, additional embodiments of a flexible package 10 are shown. An access closure 126 is formed in one of the front 12 or rear 14 panels and provides re-sealable re-closeable communication with the internal cavity 21, preferably a distance below the bubble or fluid closure. The access closure 126 can include a zipper device, re-sealable pull seals or tabs, sealable film, interlocking members, and the like. As such, the package cavity 21 can be filled with product or contents by the end consumer without altering the bubble or fluid actuated closure in the package. Once the consumer or end user provides contents or product (fluids, solids, gels, etc.) to the inner cavity 21 through the access 126, the access 126 can be selectively closed and then the contents can be forceably or selectively exited or dispensed from the cavity 21 through the bubble closure **54*a* (or interface 56). The package and access 126 can be re-usable. Access closure 126 can span the entire width of a panel of the package as shown, or it can span a lesser length. The access closure can be a zipper action re-closealable device, but other types of closures or devices can be used without departing from the scope of the invention. In those embodiments including a zipper closure 126 like that shown in FIGS. 51-54, the closure 126 can include a slit 127 (e.g., defined in package 10 panel), and first and second zipper portions 126*a*, 126*b* (e.g., film flange and/or zipper mating/interlocking profiles) attached each to the interior surface of the corresponding package panel. The access closure can be formed from the same or a different material as the rest of the package, or other materials and access device constructs known to those skilled in the art. The access closure permits a user to selectively access the internal cavity 21 of the package without opening or altering the access opening 19**.

In use, a user can open the access closure 126 and introduce or fill the internal cavity 21 with a liquid, such as a lemonade, juices and other fluids, or solids, granular substances and the like. The access closure 126 is then closed. The user can then store the contents for later retrieval or consumption via the access opening 19. Squeezing or other pressure on the outside of the package can force the contents through the interface 56 at the bubble **54*a*. Alternatively, a straw (e.g., as detailed herein) can be inserted at the bubble 54***a* and the user can suck out fluids, gels, and the like. A separate zipper or closure can be provided at the top of the package proximate or adjacent the bubble to facilitate closing or accessing the entire package. In another variation the packages could be filled, or pre-filled, with granules for mixing to form consumables, for example, granules for making lemonade or other drinks. Flexible packages of this embodiment are suitable for dispensing in flat or roll forms, such as packaging for plastic sandwich bags available in a grocery store. The throat 129 of these and other embodiments can be defined at an edge (FIG. 51), middle (FIG. 53) or at or along any portion of the package 10.

Figure 56:
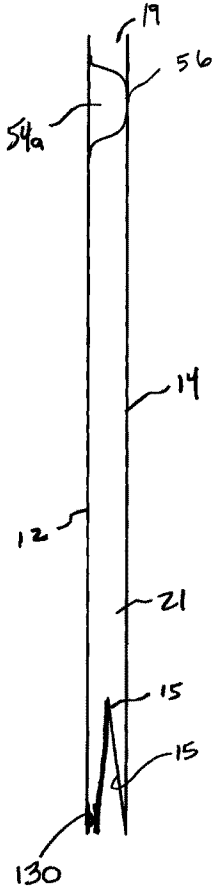
FIG. 56 is a side sectional view of the flexible package of FIG. 55, take along line 56-56.
Figure 55:
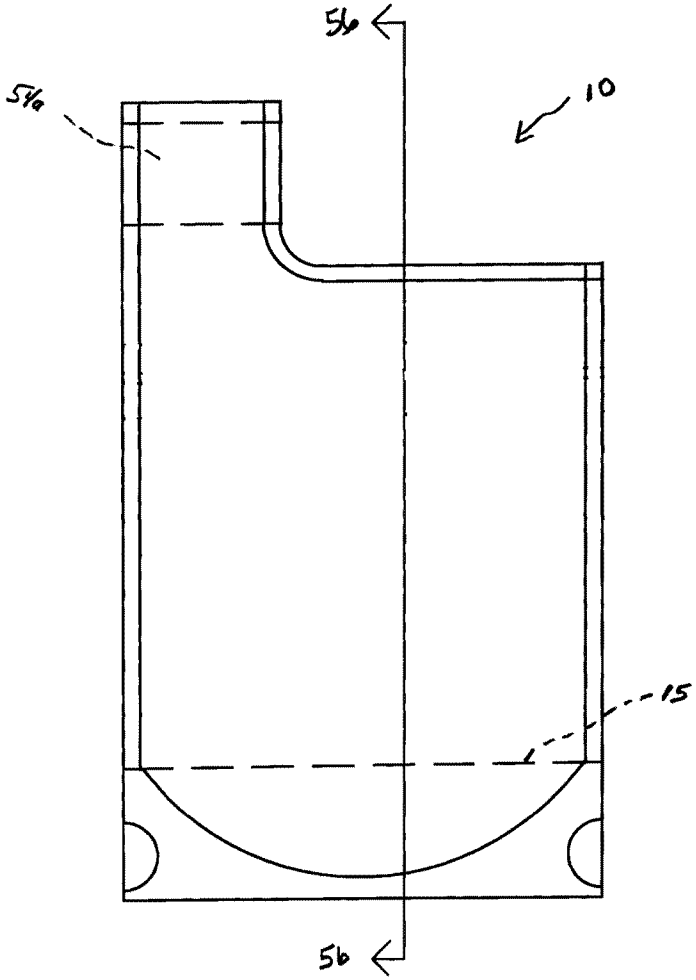
FIG. 55 is a front view of a flexible package according to an additional example embodiment.
Figure 58:
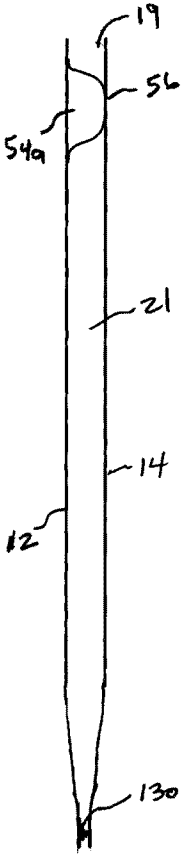
FIG. 58 is a side sectional view of the flexible package of FIG. 57, take along line 58-58.
Figure 57:
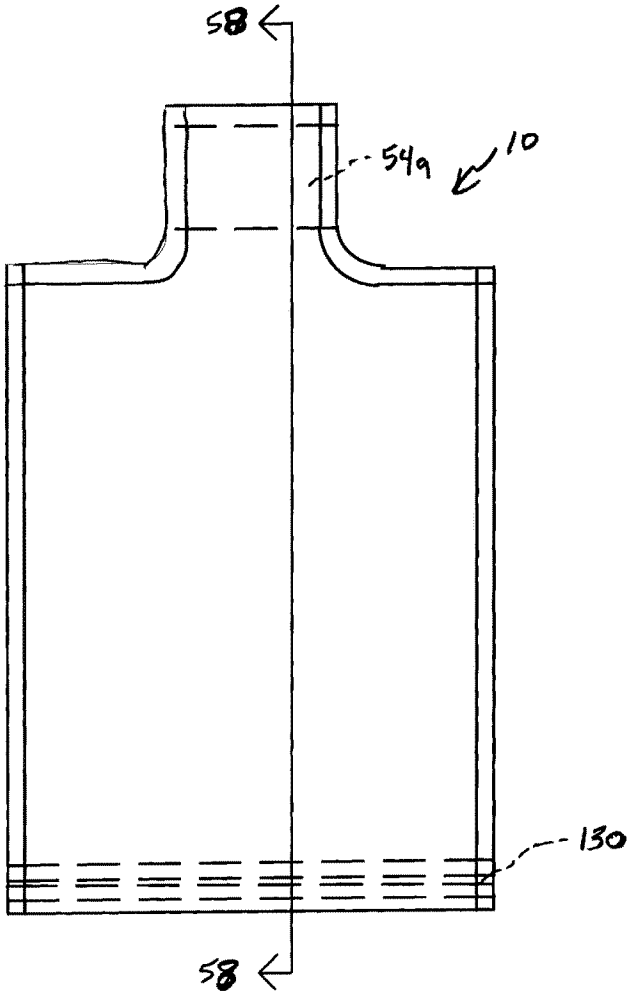
FIG. 57 is a front view of a flexible package according to an additional example embodiment.

Referring to FIGS. 55-58, similar to the embodiments of FIGS. 51-54, an access closure 130 can be included separate from the bubble or fluid closures of the package 10. For instance, the closure 130 can be a zipper or other access device provided or defined at or proximate the bottom of the package. In FIGS. 55-56, the access feature 130 is provided at the bottom panel 15 (gusseted or non-gusseted) or at the interface of the bottom panel with the front or back panel. Again, zippers or other access, or re-closeable closure devices can be utilized. Again, the closure or device 130 can be included like the access 129 to provide access to filling the interior 21 with contents by an end user or consumer. The access devices 129, 130 can be provided along nearly any panel or panel portion of the package without deviating from the spirit and scope of the present invention.

Figure 61:
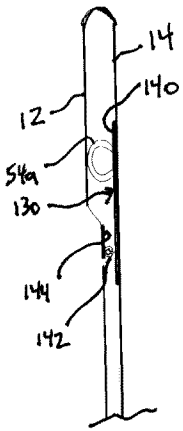
FIG. 61 is a side schematic view of the bubble closure and access device of FIG. 60.
Figure 59:
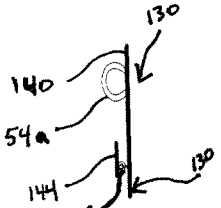
FIG. 59 is a side view of an access (e.g., zipper) device having a bubble closure in accordance with embodiments of the present invention.
Figure 60:
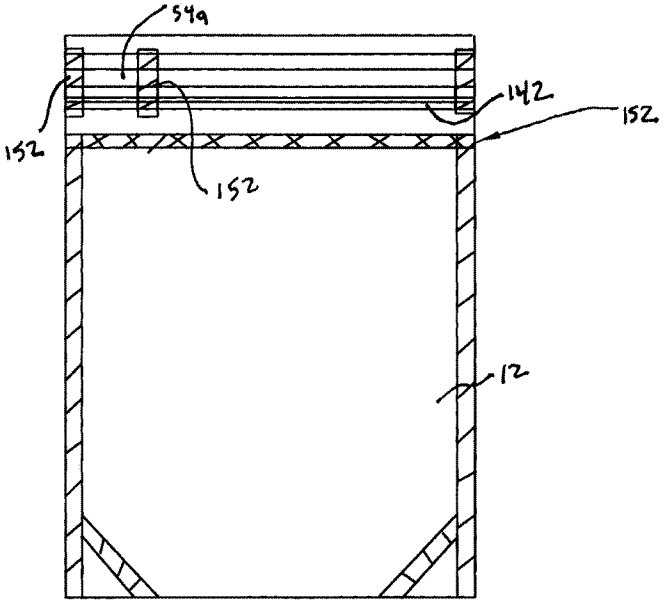
FIG. 60 is a front view of a flexible package according to embodiments of the present invention.

As shown in FIGS. 59-61, a bubble 54*a* can be provided or integrated with an access closure device 130, such as a zipper. In the embodiment of FIG. 59, the bubble 54*a* is provided with or at a flange or other extending portion 140 of the closure 130 such that the device 130 and corresponding bubble 54*a* can be attached or otherwise included with the package in one step. As such, the bubble 54*a* can be predefined or applied to the closure 130 structure and then applied to the interior of the package. The closure 130 can include a the zipper interlocking members 142 and second flange or extending member 144. The second member 144 can be attached to an interior panel surface opposing the first portion 140, or can be attached to the interior of the same panel to which the first portion 140 is provided. The bubble 54*a* can be solid, hollow, substantially solid, or substantially hollow. In various embodiments, the bubble 54*a* can be constructed of, or include, a strip of generally solid material, such as foam, silicone, or like material defining a generally domed shape configuration as depicted in the figures. The dome-shaped bubble 54*a* can emulate the construct of the air or fluid-filled embodiments described herein, wherein the bubble 54*a* has a level of shape memory such that it will remain pressed against an opposing panel or like surface to provide closure attributes, while still having a level of give or deformation characteristics when pressed, squeezed, or otherwise effected. Accordingly, once pressure or pressing is eliminated or stopped, the bubble 54*a* dome will generally return to its closing or extended position.

In use, the package can be opened at the top of the package 10, preferably proximate the first extension portion 140 such that access through the opening is provided to the bubble closure 54*a*. Filling of the package, or other later consumer use or re-use of the package to fill contents into the package, can be accomplished through the access device 130, or its zipper members 142. Again, the package with a zipper and a bubble closure can be filled, used or formed as described in detail with the embodiments disclosed herein. In certain embodiments, the extension portion 140 or other package 10 portion can, but is not required to, include a foldable or other extending portion that can define the top of the package. The package of FIG. 61 can be defined modified as such a package.

Figure 64:
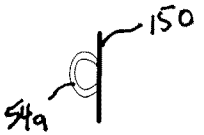
FIG. 64 is a side view of the material or strip of FIG. 63, along line 64-64.
Figure 63:
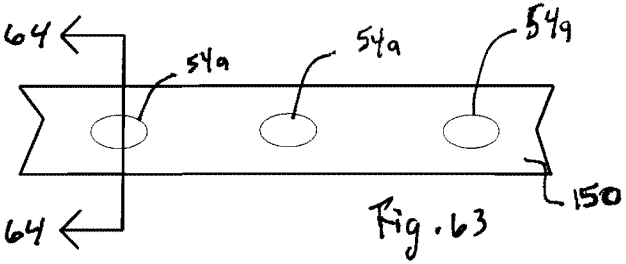
FIG. 63 is a front view of a material or strip having separate bubble closures provided therewith for including with packages of the type of FIG. 62.
Figure 62:
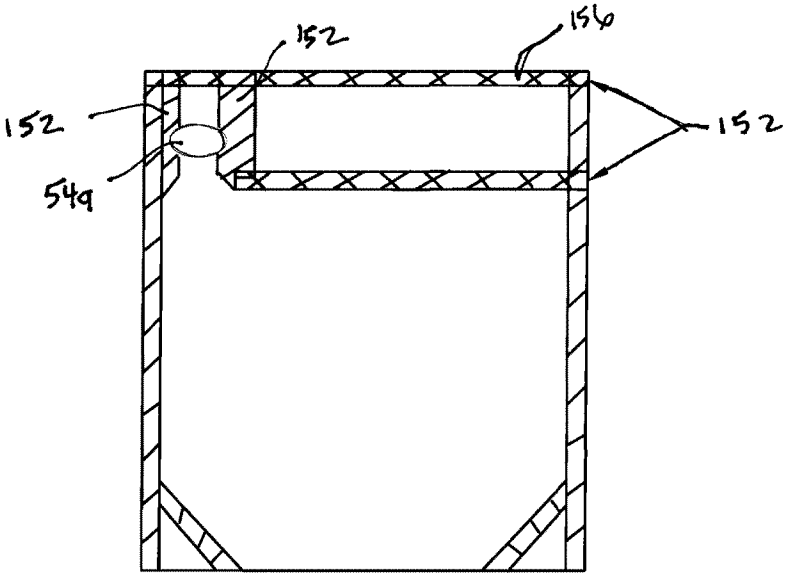
FIG. 62 is a front view of a flexible package having one or more bubble closures according to embodiments of the present invention.
Figure 67:
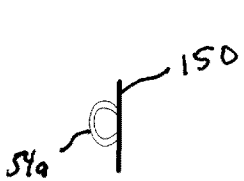
FIG. 67 is a side view of the material or strip of FIG. 66, along line 67-67.
Figure 66:
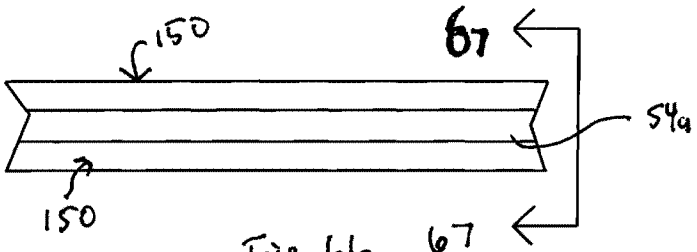
FIG. 66 is a material or strip having a tubular bubble closure portion provided therewith for including with a package of FIG. 65.
Figure 65:
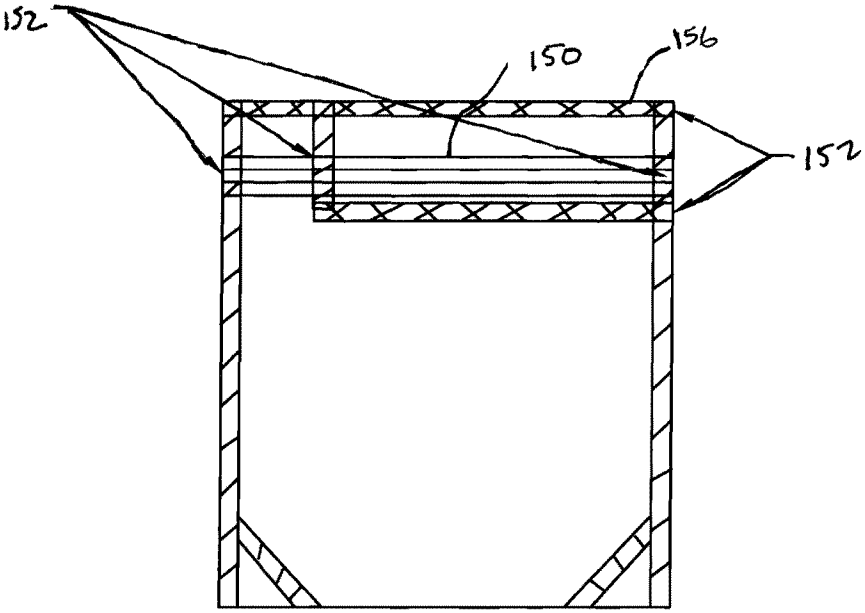
FIG. 65 is a front view of a material or strip having a tubular bubble closure portion according to embodiments of the present invention.

In various embodiments, the bubble 54*a* (e.g., solid or hollow fluid filled) can include one or more spaced and distinct bubble closures provided or pre-applied on a sheet or strip of material 150, such as those embodiments shown in FIGS. 62-64. This material can be simply applied to a desired location on the interior of the package, or can again be applied or provided with a zipper or other access device 130. In other embodiments, the bubble 54*a* (e.g., solid or hollow fluid filled) can be constructed of a long tube like construction, such as that shown in FIGS. 65-67. In each embodiment, the strip 150 or access device 130 can be selectively sealed along transverse and/or longitudinal seal or crush lines 152 to integrate the bubble 54*a*, strip 150 and/or device 130 with the package to provide the benefits and package features disclosed herein. The seals can also serve to divide up the tube or distinct bubbles 54*a*. In various embodiments, a top seal portion 156 can remain unsealed, along a portion or all of the width of the package, such that contents can be introduced into the package even after the closure 54*a* is positioned and included with the package. Once the contents are introduced, the top seal portion 156 can then be sealed such that access into the package or exiting of contents from the package is limited to the closure 54*a*, or the closure 54*a* and access device 150 in those embodiments having both (e.g., the consumer packages disclosed herein).

Any of the embodiments including the device 130 or strip 150 having the at least one bubble 54*a* (solid or fluid filled) can be included with or implemented to create the packages of various other embodiments disclosed herein (e.g., the metering packages) without deviating from the spirit and scope of the present invention. Further, the device 130, with a bubble closure and access device, or the strip 150 with at least the bubble closure, can be fed into its position and orientation with the package during the package formation process. As such, forming, inflating, or otherwise defining the bubble closure can be performed prior to package formation, such that the material or strip (e.g., including the pre-formed bubble closure) is selectively fed in for attachment or sealing during the formation of the other panel or portions of the package.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive packages. Further, features and aspects of the various embodiments described herein can be combined to form additional embodiments within the scope of the invention even if such combination is not specifically described herein.

References to front, back and side panels for the package and package formation embodiments described herein are provided to facilitate an understanding of orientation and direction and are not intended to be limiting. For instance, the bubble or fluid chambers, or other structures or portions of the package, can be provided to or along any portion of the package regardless of the references herein to front, back, side, bottom and the like.

What is claimed is:

1. A package for holding material content, comprising:

a first panel portion having first longitudinal edge portions;

a second panel portion opposite the first panel portion and having second longitudinal edge portions, at least the first and second panel portions defining an interior cavity to hold the material content;

an access portion in communication with the interior cavity including a reclosure with a fluid-actuated bubble element protruding inwardly from the first panel portion toward an opposing element, urging toward the opposing element and regulating flow through the access portion; and a flexible film extending from the first panel portion and at least partially positioned between the bubble element and the opposing element thereby shrouding at least a portion of the reclosure.

2. The package of claim 1, wherein the bubble element contains an entrapped fluid.

3. The package of claim 2, wherein the fluid is a gas.

4. The package of claim 3, wherein the gas is air.

5. The package of claim 1, wherein the material content is a fluid.

6. The package of claim 1, further including a bottom panel.

7. The package of claim 6, wherein the bottom panel is gusseted.

8. The package of claim 1, further including at least one side panel.

9. The package of claim 8, wherein the at least one side panel is gusseted.

10. The package of claim 1, further including a conduit provided at the access portion.

11. The package of claim 1, wherein the material contents selectively passes between the flexible film and the opposing element upon squeezing of the portion of the package.

12. The package of claim 1, wherein the opposing element is the second panel portion.

13. A flexible package for holding fluid content, comprising:

a first flexible panel portion;

a second flexible panel portion opposite the first flexible panel portion, at least the first and second panel portions defining an interior cavity to hold the fluid content;

an access portion in communication with the interior cavity including reclosure with a fluid-actuated, deformable and generally bubble-shaped element protruding inwardly from the first panel portion toward an opposing element, urging toward the opposing element and regulating flow through the access portion; and an interface film member extending from the first flexible panel and at least partially positioned between the bubble element and the opposing element thereby draping at least a portion of the reclosure.

14. The package of claim 13, wherein the bubble-shaped element contains an entrapped fluid.

15. The package of claim 14, wherein the fluid is a gas.

16. The package of claim 13, further including a gusseted bottom panel.

17. The package of claim 13, further including at least one side panel.

18. The package of claim 17, wherein the at least one side panel is gusseted.

19. The package of claim 13, further including a conduit provided at the access portion.

20. The package of claim 13, wherein the opposing element is the second panel portion.

* * * * *